US010642206B2

(12) United States Patent
Shinohara et al.

(10) Patent No.: US 10,642,206 B2
(45) Date of Patent: May 5, 2020

(54) IMAGE FORMING APPARATUS

(71) Applicant: CANON KABUSHIKI KAISHA, Tokyo (JP)

(72) Inventors: Seiichi Shinohara, Mishima (JP); Kazuhisa Shida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/209,736

(22) Filed: Dec. 4, 2018

(65) Prior Publication Data

US 2019/0179245 A1 Jun. 13, 2019

(30) Foreign Application Priority Data

Dec. 8, 2017 (JP) ..... 2017-236492

(51) Int. Cl.
*G03G 15/00* (2006.01)
*G03G 15/04* (2006.01)
*G03G 15/043* (2006.01)

(52) U.S. Cl.
CPC ..... *G03G 15/5033* (2013.01); *G03G 15/043* (2013.01); *G03G 15/04072* (2013.01)

(58) Field of Classification Search
CPC ..... G03G 15/04072; G03G 15/073; G03G 15/5033; G03G 2215/0404; G03G 2215/0431
See application file for complete search history.

(56) References Cited

U.S. PATENT DOCUMENTS

| | | | | |
|---|---|---|---|---|
| 4,532,552 | A | 7/1985 | Uno | 358/302 |
| 5,835,123 | A * | 11/1998 | Chung | H04N 1/40037 347/251 |
| 5,887,222 | A * | 3/1999 | Sako | G03G 15/326 399/26 |
| 5,991,008 | A * | 11/1999 | Li | G02B 26/127 355/66 |
| 6,873,350 | B2 | 3/2005 | Saito et al. | 347/239 |
| 9,606,472 | B2 | 3/2017 | Fujii et al. | G03G 15/043 |
| 2006/0181726 | A1 * | 8/2006 | Naito | G03G 15/043 358/1.14 |

(Continued)

FOREIGN PATENT DOCUMENTS

| | | |
|---|---|---|
| JP | S58-125064 | 7/1983 |
| JP | 2016-150579 | 8/2016 |
| JP | 2017-173646 | 9/2017 |

*Primary Examiner* — Carla J Therrien
(74) *Attorney, Agent, or Firm* — Venable LLP

(57) ABSTRACT

An image forming apparatus includes a rotatable photosensitive member including a photosensitive layer and a light transmitting surface layer provided outside the photosensitive layer; an exposing unit configured to expose the surface of the photosensitive member to a laser beam which deflects in a main scan direction substantially perpendicular to a moving direction of the surface of the photosensitive member, so that a latent image formed on the surface of the photosensitive member in the main scan direction; and a controller configured to control a pulse width of an image signal for switching, on the basis of image data, between projection and non-projection of the beam from the exposing unit. The controller controls the pulse width such that it is smaller than when the thickness of the surface layer is larger.

17 Claims, 12 Drawing Sheets

(56) References Cited

U.S. PATENT DOCUMENTS

| | | | | |
|---|---|---|---|---|
| 2010/0067955 | A1* | 3/2010 | Naito | B41J 2/473<br>399/221 |
| 2012/0230705 | A1* | 9/2012 | Shimura | G03G 15/011<br>399/26 |
| 2016/0370727 | A1* | 12/2016 | Nakajima | G03G 15/043 |

* cited by examiner (a)

(b)

IMAGE FORMING APPARATUS

FIELD OF THE INVENTION AND RELATED ART

The present invention relates to an image forming apparatus, such as a printing machine, a copying machine, and a facsimileing machine, which uses an electrophotographic image forming method.

An electrophotographic image forming apparatus has an exposing apparatus for exposing its photosensitive member. An exposing apparatus emits a beam of laser light while modulating the beam with the data of an image to be formed, and reflects the beam with a rotational polygonal mirror in such a manner that the beam is transmitted through a scanning lens in such a manner that the beam forms a spot of laser light on the peripheral surface of the photosensitive member. That is, an exposing apparatus forms a latent image on the peripheral surface of the photosensitive member by rotating the rotational polygonal mirror to cause the spot of laser light to move in a manner to scan the peripheral surface of the photosensitive member, in order to form a latent image on the peripheral surface of the photosensitive member. As the scanning lens, a lens having the so-called f-θ characteristic is widely used. The f-θ characteristic is such an optical characteristic of a lens that as a beam of laser light is projected upon the polygonal mirror while the mirror is rotated at a constant angular velocity, the spot formed on the peripheral surface of the photosensitive member by the beam of laser light moves along the peripheral surface of the photosensitive member at a constant speed in a manner to scan the peripheral surface of the photosensitive drum.

However, a scanning lens having the f-θ characteristic described above is substantially greater in size and cost than a scanning lens which does not have the f-θ characteristic. Therefore, from the standpoint of reducing an image forming apparatus in size and cost, it has been thought to use a scanning lens which does not have the f-θ characteristic, or not to use a scanning lens at all. It has been disclosed in Japanese Laid-open Patent Application No. S58-125064 to make an electrical adjustment to an exposing apparatus to change the image clock in frequency as the beam of laser light scans the peripheral surface of a photosensitive drum in the primary scan direction, so that even if the spot formed on the peripheral surface of the photosensitive member by the beam of laser light does not move at a constant speed, the interval between the center of one of the dots of which a latent image is formed on the peripheral surface of the photosensitive member, and the center of the immediately adjacent dot, remains constant.

However, even if an exposing apparatus is made, by the electrical adjustment such as the one described above, to remain constant in the interval between a given one of the dots of which a latent image is formed, and the immediately adjacent dot, it sometimes occurs that the dots of the resultant latent image are not uniform in diameter. Therefore, it sometimes occurs that the dots, of which a part of a latent image is formed across the lengthwise end portions of the peripheral surface of a photosensitive member in terms of the primary scan direction (lengthwise direction of photosensitive member), that is, the portions of the peripheral surface of the photosensitive member, which are relatively small in the angle of incidence of the beam of laser light relative to the peripheral surface of the photosensitive member (which hereafter may be referred to simply as angle of incidence), are longer in terms of the primary scan direction than those formed across the center portion of the peripheral surface of the photosensitive member. Hereafter, this phenomenon may be referred to as "fattening of latent image dots". Consequently, it sometimes occurs that an image forming apparatus forms such an image that appears elongated across its end portions in terms of the primary scan direction. This phenomenon may be referred to as "image elongation", hereafter. This phenomenon is one of the causes of such an image defect that the fine lines in an original image, which were formed on the portions of a sheet of transfer medium, which correspond to the lengthwise end portions of the peripheral surface of a photosensitive member, appear bolder than the original lines. It has been discovered that the thicker the surface layer of a photosensitive member (which hereafter may be referred to as "film thickness"), the greater the fattening of latent image dots is.

The fattening of the latent image dots occurs because, in the areas, in terms of the primary scan direction, where the angle of incidence of the beam of laser light relative to the photosensitive layer is relatively small, not only is the beam of laser light directly projected upon (into) the photosensitive layer of the photosensitive member, but also, a part of the beam of laser light is deflected by the interface between the charge transfer layer and photosensitive layer, deflected by the interface between the charge transfer layer and the body of ambient air (or interface between charge transfer layer and protective layer of photosensitive member), and then, is projected into the photosensitive layer for the second time. In a case where a scanning lens having the f-θ characteristic is employed, the deviation of the point of the photosensitive layer, upon which the beam of laser light is directly projected, from the point of the photosensitive layer, upon which the part of the beam of laser light, is projected after being deflected by the interface between the charge transfer layer and photosensitive layer of the photosensitive member, and then, by the interface between the charge transfer layer and the body of ambient air, is small enough to be ignored. In comparison, in a case where a scanning lens having the f-θ characteristic is not employed, the angle of incidence of the beam of laser light across the end portion of the peripheral surface of the photosensitive member in terms of the primary scan direction is relatively small compared to a case where a scanning lens having the f-θ characteristic is employed. Therefore, the effects of the above-described deflected portion of the beam of laser light is more apparent. Further, in a case where a photosensitive member is relatively great in film thickness, the effects of the deflected portion of the beam of laser light is greater than in a case where the photosensitive member is relatively less in the film thickness, because in a case where a photosensitive member is relatively great in film thickness, the light path of the deflected portion of the beam of laser light is longer in a case where the photosensitive member is greater in the film thickness. Therefore, the fattening of the latent image dots are likely to be more apparent when the photosensitive member is brand-new than when the photosensitive member is coming to the end of its life span, or the like period, because when the photosensitive member is brand-new, it is greater in the film thickness than when it is in the end of its life span, or the like period. Further, in a case where the four photosensitive members of a color image forming apparatus are different in film thickness, image defects related to color deviation sometimes occur, because the four monochromatic toner images which the color image forming apparatus forms are different in the amount of fattening of the latent image dots.

Further, as a photosensitive member is used, its surface layer is shaved. In other words, a photosensitive member is an expendable member of an image forming apparatus. Therefore, it is difficult to solve the problems described above, with the use of a photosensitive member, the surface layer of which is thin even when it is brand-new.

Therefore, the object of the present invention is to provide an image forming apparatus which does not employ a scanning lens having the f-θ characteristic, and yet, does not form images which suffer from the fattening of the latent image dots.

SUMMARY OF THE INVENTION

According to a firstg aspect of the present invention, there is provided an image forming apparatus comprising a rotatable photosensitive member including a photosensitive layer and a light transmitting surface layer provided outside said photosensitive layer; an exposing unit configured to expose said surface of said photosensitive member to a laser beam which deflects in a main scan direction substantially perpendicular to a moving direction of said surface of said photosensitive member, so that a latent image formed on said surface of said photosensitive member in the main scan direction; and a controller configured to control a pulse width of an image signal for switching, on the basis of image data, between projection and non-projection of the laser beam from said exposing unit, wherein said controller control the pulse width such that the pulse width is smaller than when the thickness of said surface layer is larger.

According to another aspect of the present invention, there is provided an image forming apparatus comprising a rotatable photosensitive member including a photosensitive layer and a light transmitting surface layer provided outside said photosensitive layer; an exposing unit configured to expose said surface of said photosensitive member to a laser beam which deflects in a main scan direction substantially perpendicular to a moving direction of said surface of said photosensitive member, so that a latent image formed on said surface of said photosensitive member in the main scan direction; and a controller configured to control said exposing unit on the basis of image data, wherein said controller controls said exposing unit such that a number of pixels of the image data in the main scan direction is smaller as a thickness of the surface layer is larger.

Further features of the present invention will become apparent from the following description of exemplary embodiments with reference to the attached drawings.

Figure 4:
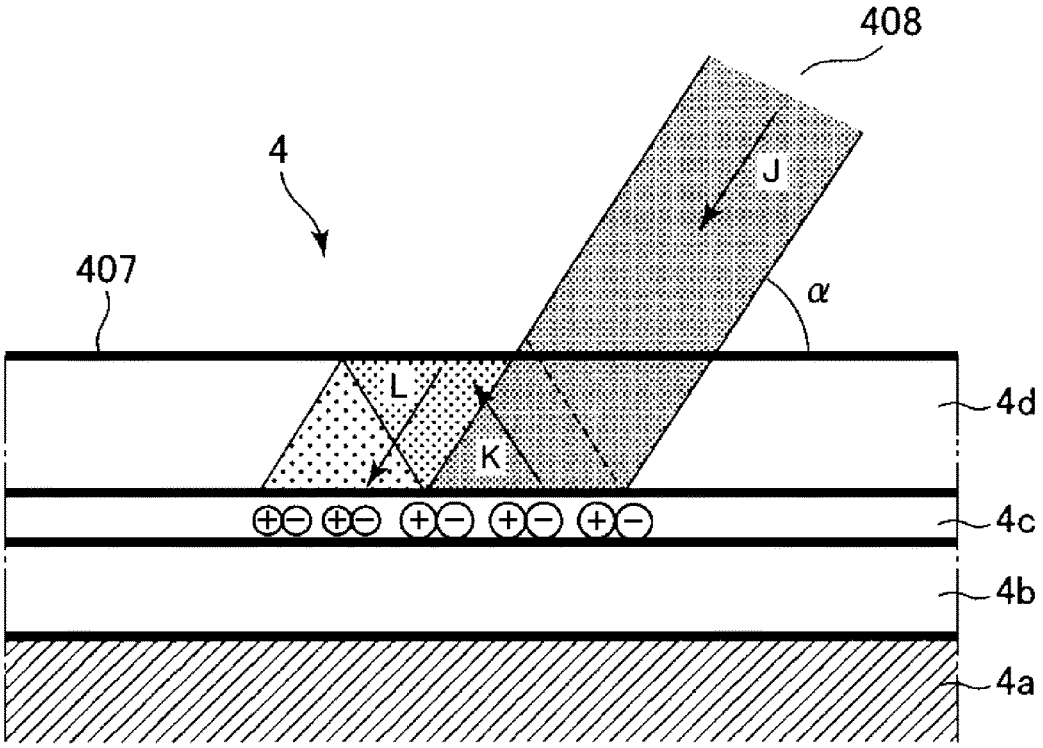
Figure 4:
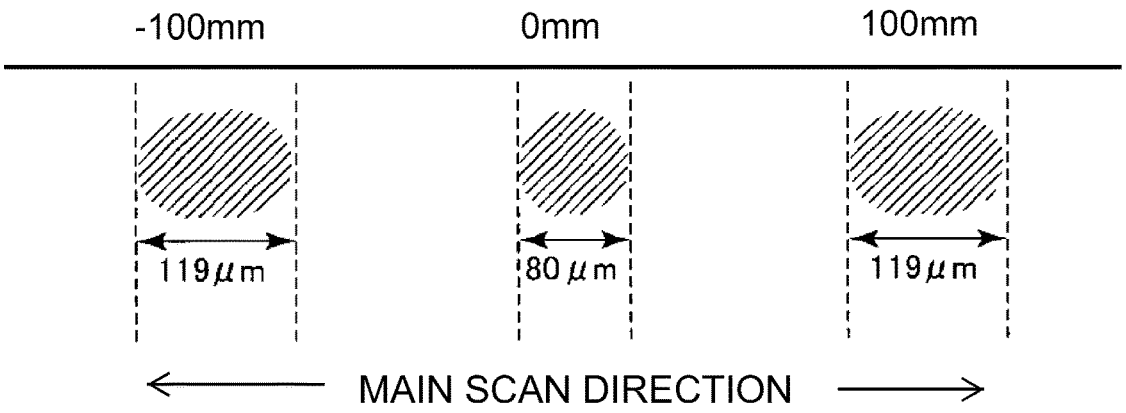

Parts (a) and (b) of FIG. 4 are schematic views for illustrating the fattening of latent image dots.

Figure 5:
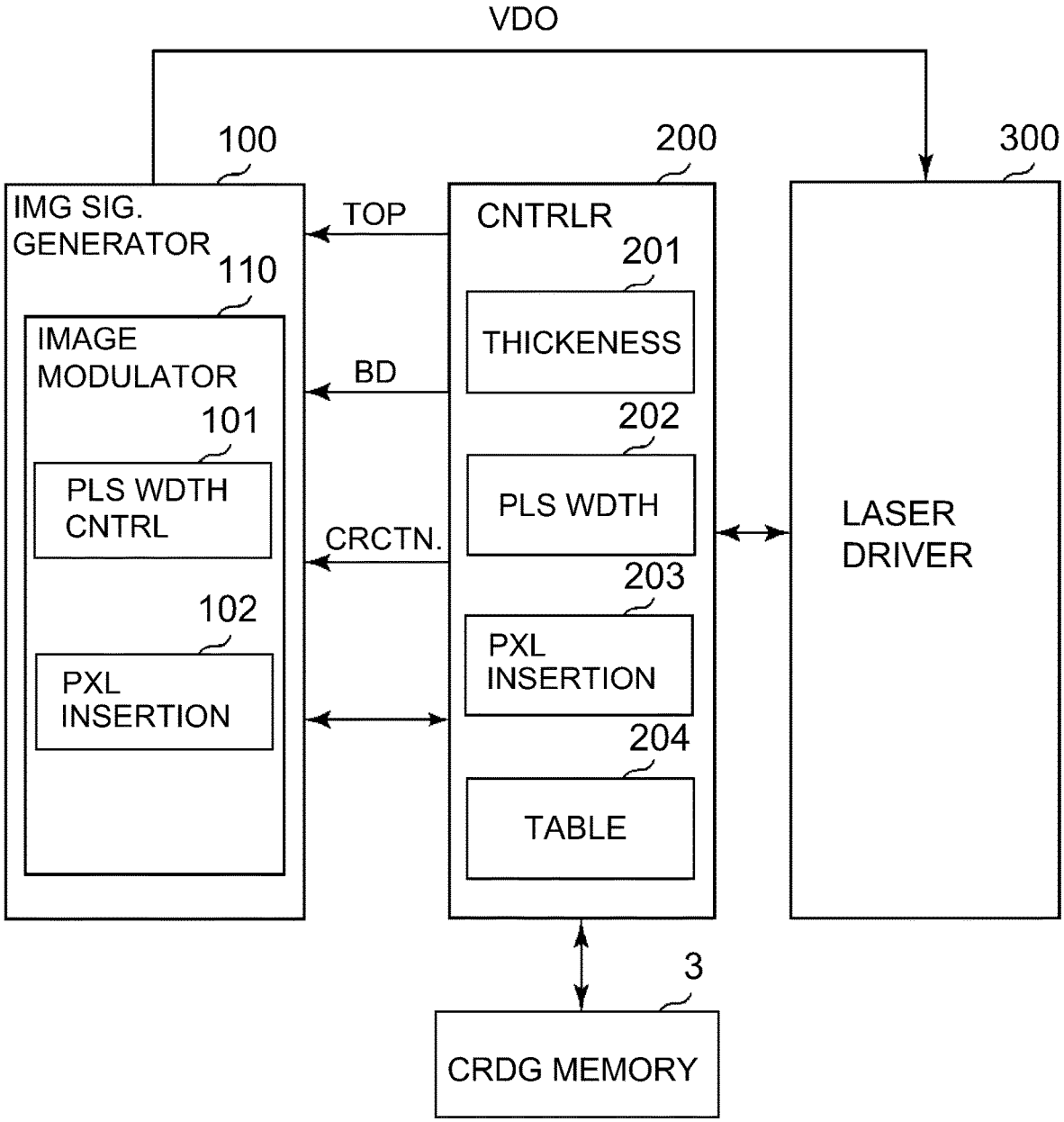

FIG. 5 is a block diagram of the portion of the image forming apparatus, in the first embodiment, which is essential to the controlling of the apparatus.

Figure 6:
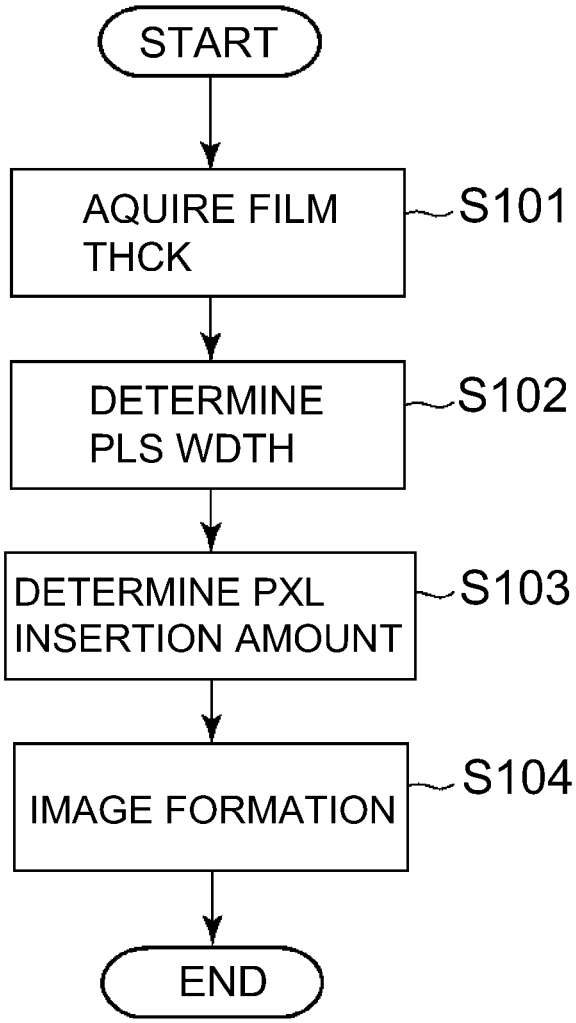

FIG. 6 a flowchart of the image forming operation of the image forming apparatus in the first embodiment; it is for describing the procedure for adjusting (controlling) the image forming apparatus to prevent the formation of "fat dots".

Figure 7:
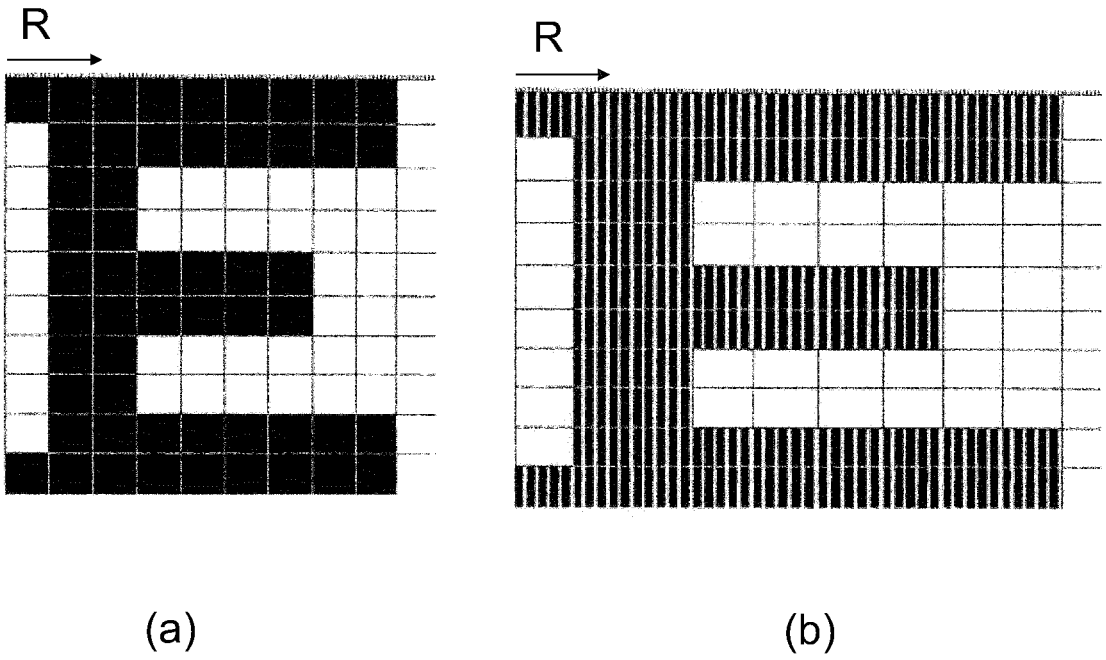

Parts (a) and (b) of FIG. 7 are schematic views for explaining how image formation signals are processed to adjust (controlling) the image clock in frequency.

Figure 8:
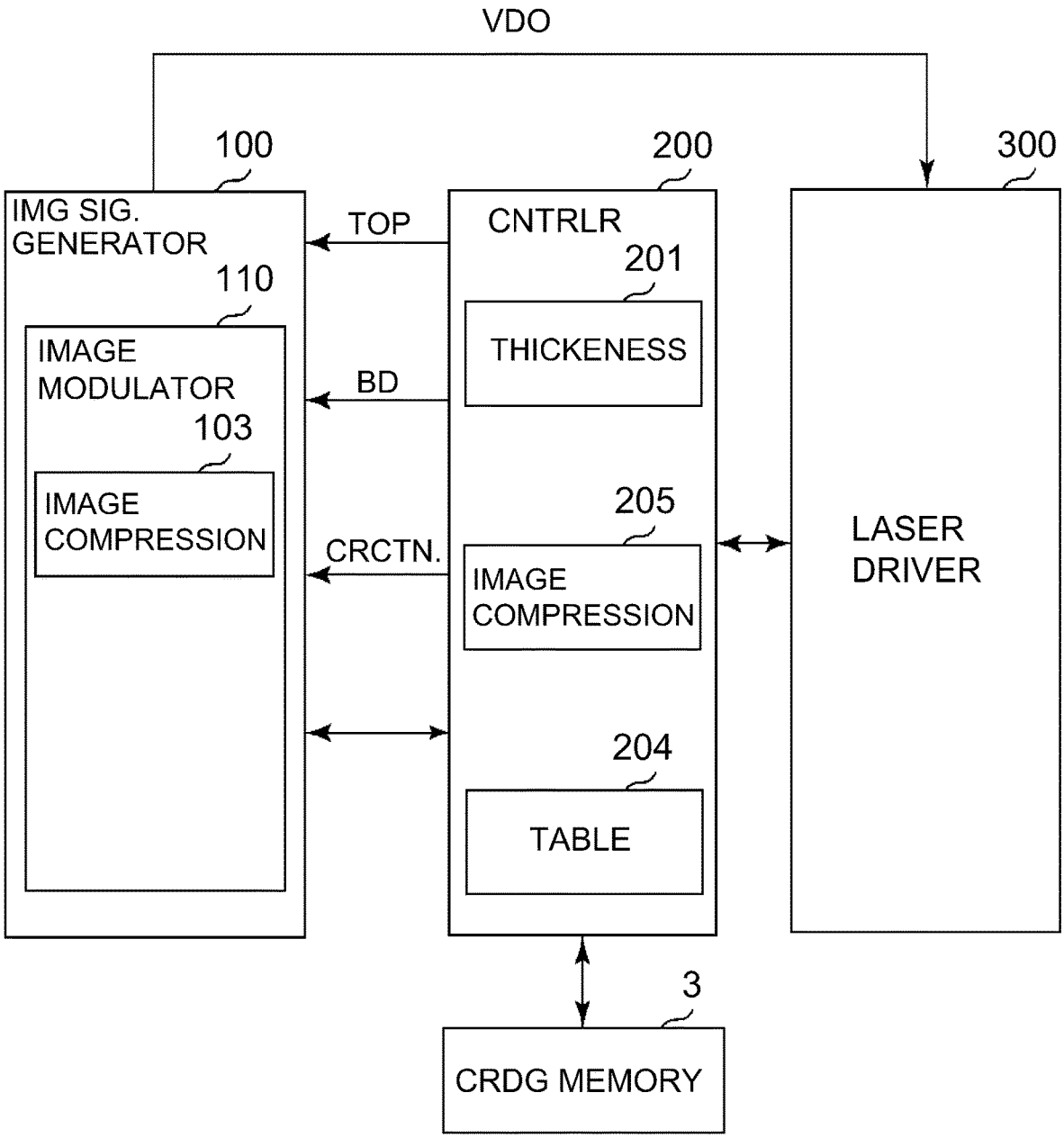

FIG. 8 is a block diagram of the portion of another example of image forming apparatus, which is essential to the controlling of the apparatus.

Figure 9:
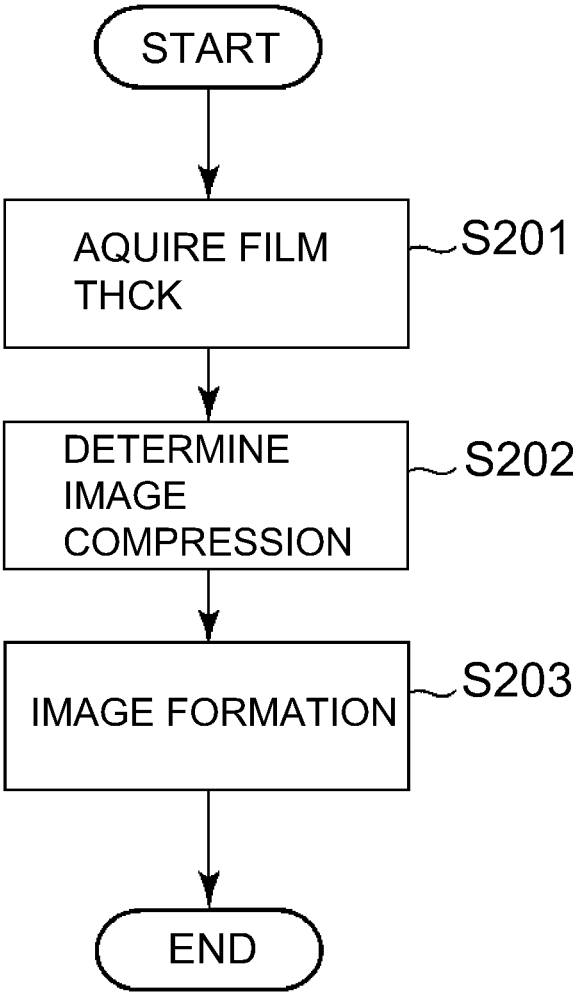

FIG. 9 is a flowchart of the image forming operation of an image forming apparatus; it is for describing another procedure for adjusting (controlling) the image clock in frequency.

Figure 10:
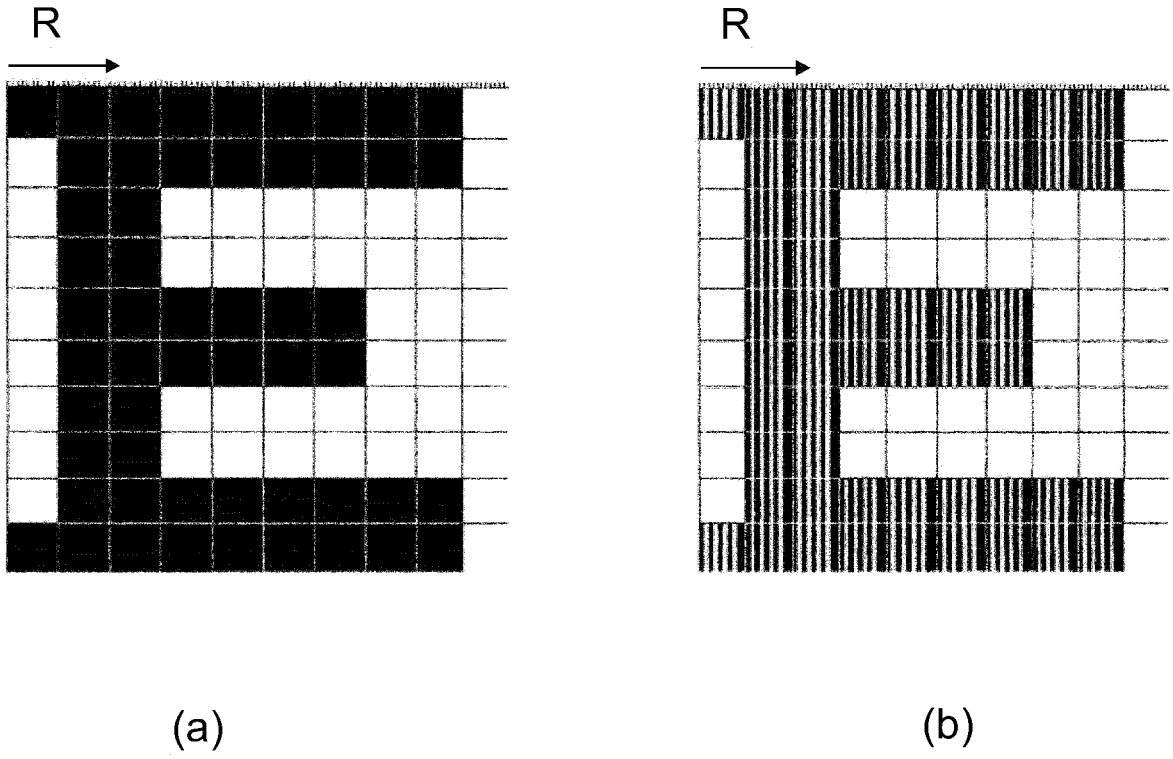

Parts (a) and (b) of FIG. 10 are schematic views for explaining how image formation signals are processed to adjust (controlling) the image clock in frequency in another example of image forming apparatus.

Figure 11:
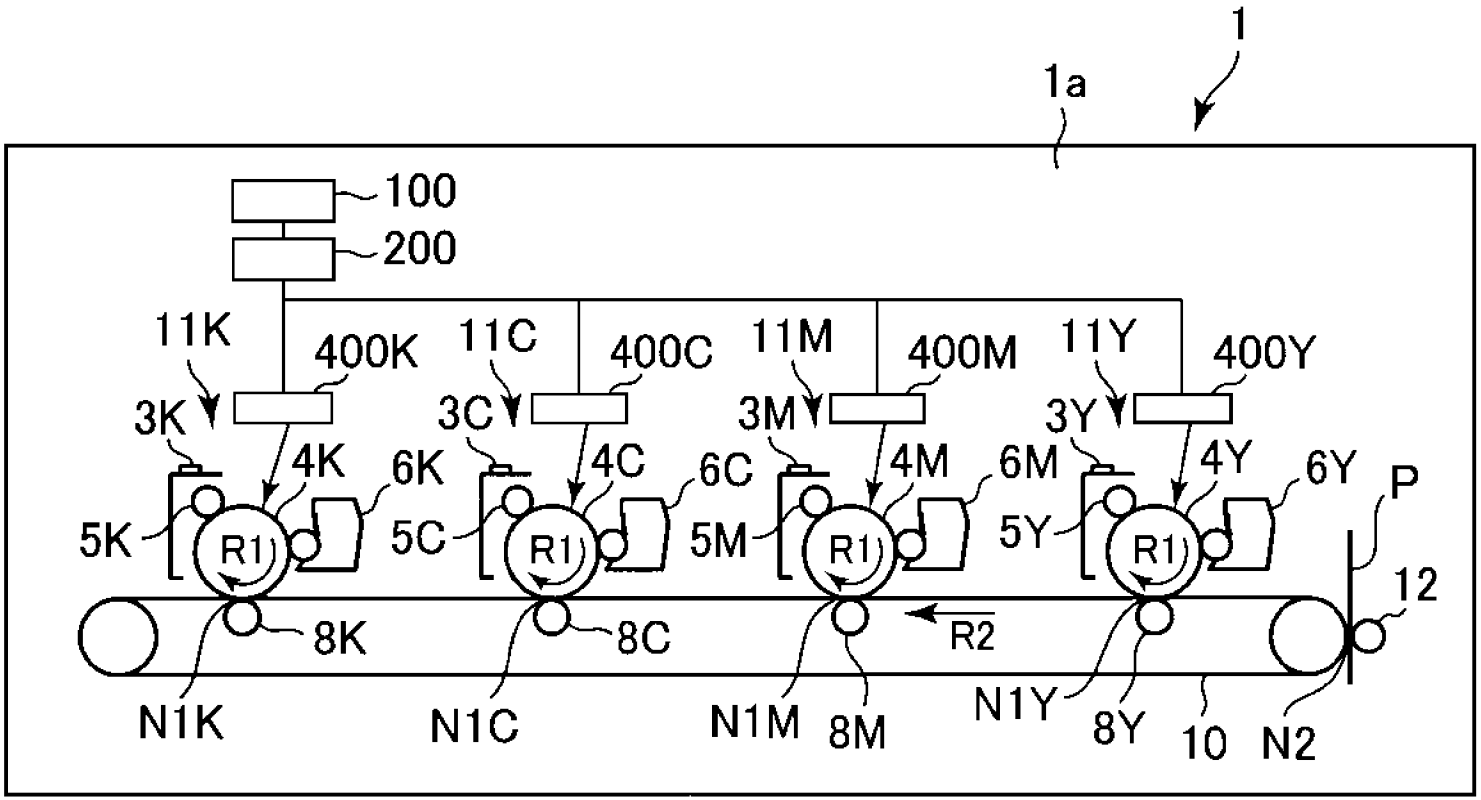

FIG. 11 is a schematic sectional view of a typical color image forming apparatus to which the present invention is applicable.

Figure 12:
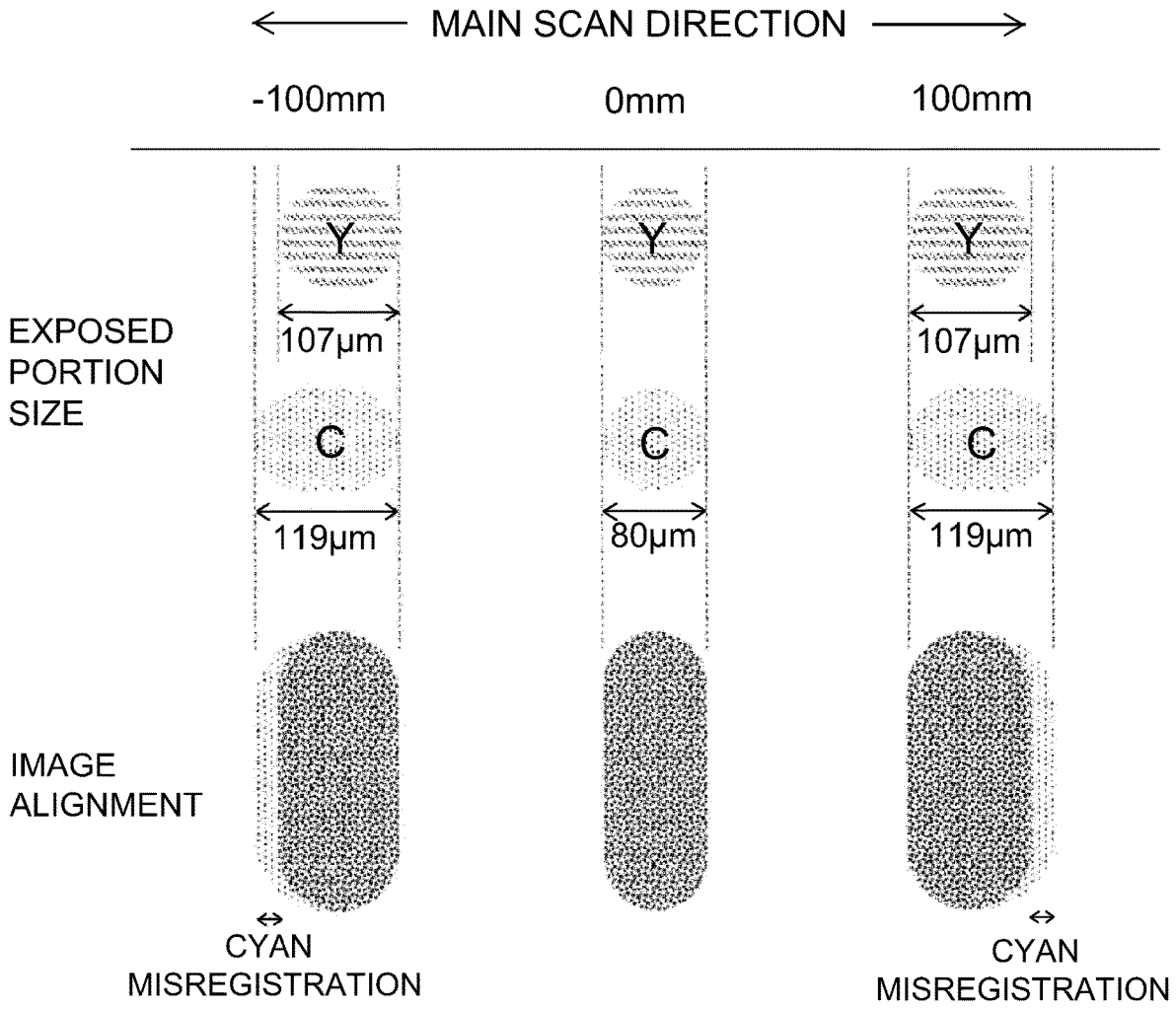

FIG. 12 is a schematic drawing for describing color deviation.

DESCRIPTION OF THE EMBODIMENTS

Hereinafter, the present invention is described in greater detail with reference to image forming apparatuses which are in accordance with the present invention, referring to appended drawings.

[Embodiment 1]

1. Overall structure and operation of image forming apparatus

Figure 1:
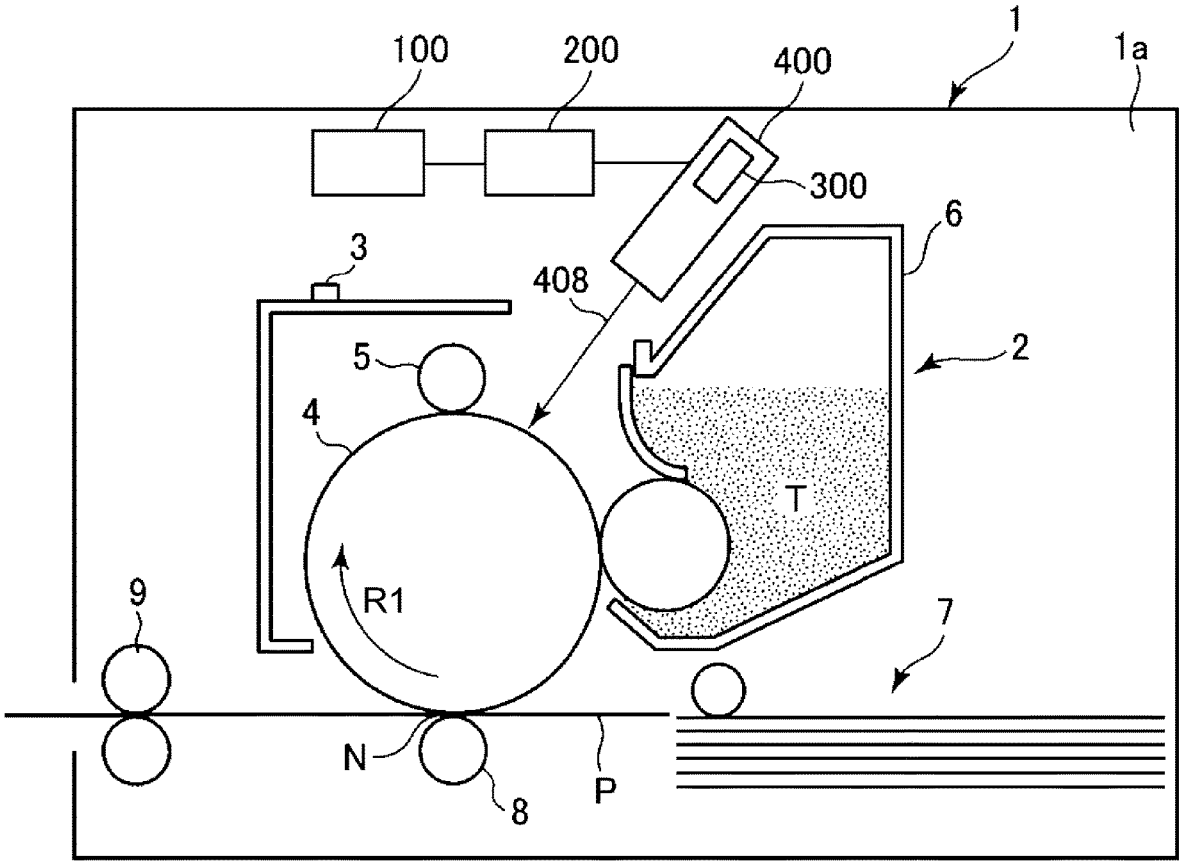
FIG. 1 is a schematic sectional view of an image forming apparatus in the first embodiment of the present invention.

FIG. 1 is a schematic sectional view of the image forming apparatus 1 in this embodiment of the present invention. The image forming apparatus 1 in this embodiment is a laser beam printer which uses an electrophotographic image forming method.

The image forming apparatus 1 has a photosensitive drum 4, which is a rotatable photosensitive member (electrophotographic photosensitive member), and is in the form of a drum (cylindrical). The photosensitive drum 4 is rotationally driven in the direction indicated by an arrow mark R1 in the drawing. As the photosensitive drum 4 is rotated, its peripheral surface is uniformly charged to preset polarity (negative in this embodiment) and a preset potential level, by a charge roller 5 as a charging means. The charge roller 5 is a charging member in the form of a roller. After being charged by the charge roller 5, the peripheral surface of the photosensitive drum 1 is scanned by (exposed to) the beam of laser light emitted by an exposing apparatus 400 as an exposing means. As a result, an electrostatic latent image is formed on the peripheral surface of the photosensitive drum 4. In this embodiment, the exposing apparatus 400 is a laser beam scanner, which forms an electrostatic latent image on the peripheral surface of the photosensitive drum 1 with the use of a beam of laser light. The electrostatic latent image formed on the peripheral surface of the photosensitive drum 4 is supplied with toner T, as developer, by a developing apparatus 6 as a developing means, being thereby developed into a visible image. That is, an image is formed of toner, on the peripheral surface of the photosensitive drum 4. Hereafter, this image formed of toner is referred to as a toner image.

The image forming apparatus 1 is provided with a transfer roller 8, which is positioned in a manner to oppose the photosensitive drum 4. The transfer roller 8 is a transferring means. It is a transferring member in the form of a roller. It is kept pressed against the peripheral surface of the photosensitive drum 4 with the application of a preset amount of pressure, forming thereby a transfer nip N, in which the photosensitive drum 4 remains in contact with the transfer roller 8. A toner image formed on the peripheral surface of the photosensitive drum 4 is transferred onto a sheet of transfer medium (recording medium, sheet) such as a sheet of paper, while the sheet P is conveyed through the transfer nip N, remaining pinched between the photosensitive drum 4 and transfer roller 8. During the transfer, transfer bias, which is opposite in polarity from the normal toner charge, is applied to the transfer roller 8. Each sheet P of transfer medium is conveyed from a sheet feeder unit 7 to the transfer nip N, with such timing that the toner image on the photosensitive drum 4 arrives at the transfer nip N at the same time as the sheet P. After the transfer of the toner image onto the sheet P, the sheet P is conveyed to a fixing apparatus 9 as a fixing means, and is conveyed through the fixing apparatus 9. While the sheet P is conveyed through the fixing apparatus 9, the sheet P is heated and pressed by the fixing apparatus 9. As a result, the toner image is melted, and then, becomes fixed to the sheet P as it cools down. Then, the sheet P is discharged from the main assembly 1*a* (which hereafter may be referred to simply as apparatus main assembly) of the image forming apparatus 1.

2. Exposing apparatus

Figure 2:
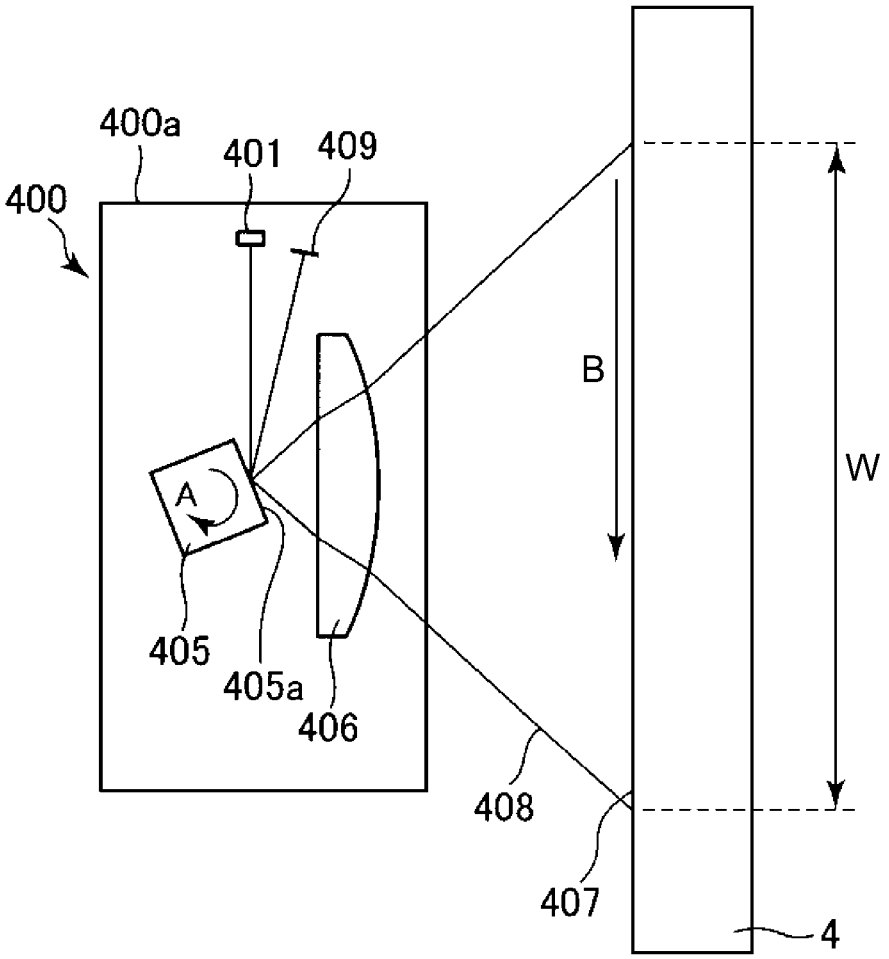
FIG. 2 is a schematic sectional view of the exposing apparatus in the first embodiment.

FIG. 2 is a sectional view of the exposing apparatus 400 in this embodiment, at a horizontal plane which is parallel to the primary scan direction of the apparatus 400. It includes the sectional view of the photosensitive drum 4 as well. A beam 408 of laser light is emitted from a light source 401, and is reflected (deflected) by a reflective surface 405*a* of a polygonal mirror 405 (rotational polygonal mirror) as a Polaris cope. As the beam 408 of laser light reflected by the reflective surface 405*a*, it transmits through a focal lens 406, and hits the peripheral surface of the photosensitive drum 4. The portion of the peripheral surface of the photosensitive drum 4, which the beam 408 of laser light scans after its transmission through the focal lens 406, is the image formation area 407, or the portion to be scanned by the beam 408. The beam 408 of laser light is focused on the image formation area 407 of the peripheral surface of the photosensitive drum 4, forming a light spot having a preset size. As the polygonal mirror 405 is rotated by an unshown driving portion, in the direction indicated by an arrow mark A, at a constant angular velocity, the light spot moves across the image formation area 407, in the primary scan direction indicated by an arrow mark B in the drawing. Eventually, a latent image is formed on the image formation area 407.

By the way, the "primary scan direction" means such a direction that is roughly parallel to the lengthwise direction of the photosensitive drum 4 (direction parallel to rotational axis of photosensitive drum 4), and is roughly perpendicular to the rotational direction of the photosensitive drum 4 (moving direction of peripheral surface of photosensitive drum 4). The "secondary scan direction" means such a direction that is roughly perpendicular to the primary scan direction, and is roughly parallel to the rotational direction of the photosensitive drum 4 (moving direction of peripheral surface of photosensitive drum 4). In terms of the primary scan direction, the area of the peripheral surface of the photosensitive drum 4, across which a latent image can be formed, and which is W in width, is referred to also as "scanning range". When a given position in the scanning range is referred to, it may not be mentioned sometimes that the position is defined in terms of the "primary scan direction."

A beam detection sensor 409 (which hereafter may be referred to also as "BD") is used to determine the timing with which a latent image begins to be written across the image formation area 407. The timing, with which the writing of a latent image across the image formation area 407 is to be started, is controlled based on the timing with which a beam of laser light is detected by the BD sensor 409.

In this embodiment, the light source 401 is a semiconductor laser chip. The light source 401 is provided with a single unshown light emitting portion. As the light source 401, however, a semiconductor chip having two or more independently controllable light emitting portions may be used. Even in a case where a light source having two or more light emitting portions is used as the light source 401, each of the two more beams of light emitted by the light source 401 is deflected by the polygonal mirror 405 and transmits through the focal lens 406, and then, reaches the image formation area 407, forming a light spot which is offset in the secondary scan direction from a light spot formed by the other light emitting portions.

Further, the exposing apparatus 400 has a casing 400*a* which is an optics box. Various optical members such as the aforementioned light source 401, focal lens 406, polygonal mirror 405, etc., are held in this casing 400*a*.

In this embodiment, the focal lens 406 does not have the so-called f-θ characteristic. That is, the focal lens 406 does not have such a characteristic that causes the spot which the beam 408 of laser light forms on the image formation area 407 after it transmits through the focal lens 406, to move on the image formation area 407 at a constant angular velocity. With the use of a focal lens 406, it is possible to position a lens closer to the polygonal mirror 405. That is, it is possible to reduce the distance between the focal lens 406 and polygonal mirror 405 in terms of the left-right direction in FIG. 2. Further, the focal lens 406 which does not have the f-θ characteristic, is less in the width in terms of the primary scan direction, and the thickness in terms of the optical axis direction, than a focal lens having the f-θ characteristic. In this embodiment, therefore, the focal lens 406 which does not have the f-θ characteristic was used to reduce in size the casing 400*a* of the exposing apparatus 400.

3. Process cartridge

Figure 3:
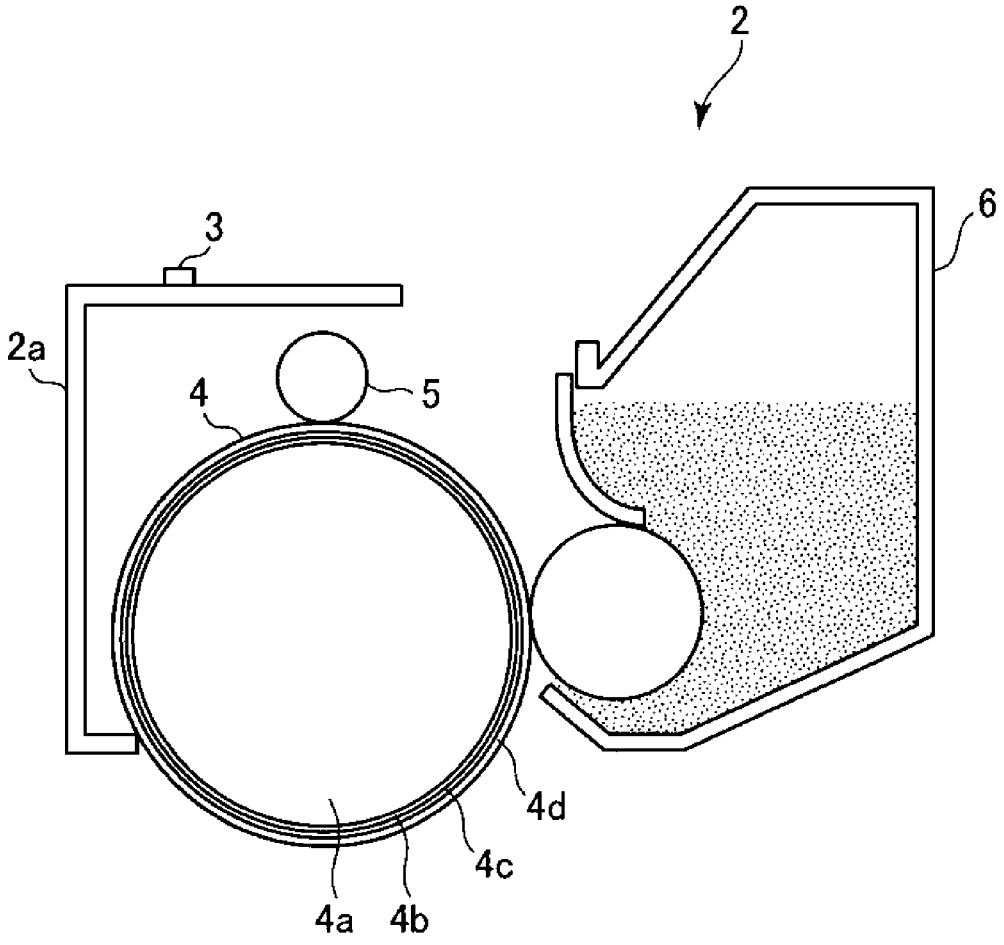
FIG. 3 is a schematic sectional view of the process cartridge in the first embodiment.

FIG. 3 is a schematic sectional view of a process cartridge 2, which is removably installable in the image forming apparatus 1. In this embodiment, the photosensitive drum 4, and processing means, more specifically, the charge roller 5 and developing apparatus 6, which are for processing the photosensitive drum 4, are integrally held in a frame 2*a*, making up the process cartridge 2 which is removably installable in the main assembly 1*a* of the image forming apparatus 1. Further, in this embodiment, the process cartridge 2 is provided with a cartridge memory 3 (storing portion) as a storing means. This cartridge memory 3 is attached to the exterior of the frame 2*a* of the process cartridge 2. Thus, as the process cartridge 2 is installed into the apparatus main assembly 1*a*, it becomes possible for a control portion 200 (FIG. 5), with which the apparatus main assembly 1*a* is provided, to read the information in the cartridge memory 3, and also, write information into the cartridge memory 3.

In this embodiment, the photosensitive drum 4 is made up of an aluminum cylinder 4*a* as an electrically conductive substrate, and three layers, more specifically, an electrically resistive layer 4*b*, a photosensitive layer 4*c*, and a charge transfer layer 4*d*, which are layered in the listed order, on the peripheral surface of the aluminum cylinder. In this embodiment, the charge transfer layer 4*d* is the surface layer of the photosensitive drum 4. In this embodiment, −1000 V of DC voltage is applied as bias to the charge roller 5 from an unshown high voltage power source, during the charging process. By the way, the aluminum cylinder 4*a* is grounded through the apparatus main assembly 1*a*. Thus, the surface of the charge transfer layer 4*d* of the photosensitive drum 4 is uniformly charged to roughly −550 V, which is the difference in potential level between the DC bias (−1000 V) and discharge start voltage.

After being charged, the photosensitive drum 4 is exposed to the beam 408 of laser light emitted from the exposing apparatus 400. The beam 408 of laser light transmits through the charge transfer layer 4*d*, which is the transparent surface layer of the photosensitive drum 4, and then, reaches the photosensitive layer 4*c*. By the way, that the surface layer of the photosensitive drum 4 is transparent means that the surface layer is transparent enough to allow the beam 408 of laser light or the like, which is necessary for the image forming apparatus to function, and which the exposing apparatus 400 projects upon the photosensitive drum 4 to form a latent image to form the latent image, to satisfactorily transmit through the surface layer and reach the photosensitive layer 4*c*. As the beam 408 of laser light reaches the photosensitive layer 4*c*, an electron-positive hole pair is generated in the photosensitive layer 4*c* by optical excitation. Since the peripheral surface of the photosensitive drum 4 has been charged to −550 V in advance by charge roller 5, the positive holes move into the charge transfer layer 4*d*, canceling thereby electrical charge. In other words, the exposed portion of the peripheral surface of the photosensitive drum 4 reduces in potential level, in terms of the absolute value. Consequently, a latent image is effected by the difference in potential level between the exposed portions and unexposed portions.

In this embodiment, information (which may be referred to as film thickness information) regarding the film thickness of the photosensitive drum 4, that is, the thickness of the surface layer of the photosensitive drum 4 (charge transfer layer 4*d* in this embodiment) is stored in the cartridge memory 3. As an image forming operation is repeated by the image forming apparatus 1, the charge transfer layer 4*d*, or the outermost layer of the photosensitive drum 4, is gradually shaved by the electrical discharge which occurs when the photosensitive drum 4 is charged by the charge roller 5, and also, by being rubbed by the developing apparatus 6 and sheets P of transfer medium. Therefore, as the photosensitive drum 4 increases in the cumulative amount of usage, the surface layer of the photosensitive drum 4 gradually changes in thickness (reduces in thickness, ordinarily).

The film thickness of the photosensitive drum 4 is predictable based on the information regarding the amount of the usage of the photosensitive drum 4. As the information regarding the amount of usage of the photosensitive drum 4, any index related to the amount of usage of the photosensitive drum 4 can be used. For example, the cumulative number of rotations of the photosensitive drum 4, cumulative length of time the photosensitive drum 4 was rotated during the charging process, cumulative number of times the photosensitive drum was rotated while the photosensitive drum 4 was charged, can be used. Moreover, two or more of the abovementioned indexes may be used in combination. In such a case, the film thickness information may be the information related to the amount of usage of the photosensitive drum 4, film thickness of the photosensitive drum 4 obtained from these information, etc. Further, the film thickness of the photosensitive drum 4 can be directly detected with the use of a film thickness measuring device of the so-called eddy current type, or the like. In such a case, the film thickness information may be the value of a detection signal, which corresponds to the measuring method, film thickness value obtained from the detection signal value, etc. In this embodiment, from the standpoint of reducing the image forming apparatus 1 in size and cost, a method for predicting the film thickness of the photosensitive drum 4 based on the cumulative length of time the photosensitive drum 4 has been rotated since when the photosensitive drum 4 was brand-new was used. That is, in this embodiment, the cumulative length of time the photosensitive drum 4 was rotated since when the photosensitive drum 4 was brand-new is successively stored in the cartridge memory 3 each time the process cartridge 2 is used for an image forming operation. Then, the current film thickness of the photosensitive drum 4 is obtained from the current cumulative length of time the photosensitive drum 4 has been rotated, based on the relationship obtained in advance between the cumulative length of time the photosensitive drum 4 has been rotated, and the film thickness of the photosensitive drum 4.

Further, there are occasions in which various process cartridges 2 which are installable in the apparatus main assembly 1*a* and are different in the number of prints they can yield are lined up. In such cases, it is possible that the various cartridges are different in the film thickness of their photosensitive drum 4 when the cartridges are brand-new, will be used. Also in such cases, the information regarding the film thickness of the photosensitive drum 4 in each process cartridge 2 when the process cartridge 2 was brand-new may be stored in the cartridge memory 3 of each process cartridge 2. That is, the information regarding the film thickness of each of various process cartridges 2 which are different in the number of print yield when each cartridge is brand-new may be stored in the cartridge memory 3 of each cartridge. The information regarding the film thickness of the photosensitive drum 4 in a process cartridge when the cartridge is brand-new can be stored in the cartridge memory 3 during the manufacturing of the cartridge, or when the cartridge is shipped out of a cartridge factory. The film thickness of each cartridge when the cartridge is brand-new may be the information regarding the identification of each cartridge, which can be converted by the main assembly of an image forming apparatus, into a film thickness value as information which indicates the film thickness, information regarding the model number of each cartridge, or the like, in addition to the film thickness value of the photosensitive drum 4 of each of the brand-new cartridges. By the way, in these cases, the current film thickness of the photosensitive drum 4 can be estimated by subtracting the amount by which the photosensitive drum 4 is reduced in film thickness, and which can be obtained from the information regarding the current amount of photosensitive drum (cartridge) usage, from the film thickness value of the photosensitive drum 4 when the photosensitive drum 4 was brand-new, or subtracting the current cumulative amount of drum (cartridge) usage, from the total length of time each cartridge (photosensitive drum 4) can be rotated (used) since when it is brand-new, which is stored in the cartridge memory 3 when the cartridge is brand-new. Further, as the information which includes the film thickness of the photosensitive drum 4 when the drum 4 is brand-new, the information which shows the relationship between the cumulative length of time the photosensitive drum 4 is predicted to be rotatable and the film thickness of the photosensitive drum 4, may be stored as the information which includes the information regarding the film thickness of the photosensitive drum 4 when the drum 4 is brand-new.

By the way, the surface layer of the photosensitive drum 4 does not need to be the charge transfer layer 4*d*. For example, the photosensitive drum 4 may be provided with a protective layer, as the surface layer, which does not have the charge transfer function. In such a case, if the photosensitive drum 4 reaches the end of its life span before the protective layer wears out, the value which indicates the thickness of the surface layer is the thickness of the protective layer. If the photosensitive drum 4 reaches the end of its life span as the protective layer wears out, the value which indicates the thickness of the surface layer is the thickness of the charge transfer layer.

Further, this embodiment is not intended to limit the present invention in scope, in terms of the method for obtaining the information regarding the film thickness. That is, the present invention is compatible with any method usable to obtain the film thickness information.

4. Fattening of dots

In a case where the focal lens 406 which does not have the f-θ characteristic is used, the speed with which the beam 408 of laser light scans (move across) a given portion of the image formation area 407 is different from the one with which the beam 408 scans (moves across) the other portions. Further, the angle of incidence of the beam 408 of laser light at a given point of the image formation area 407 is different from the one at the other points. In particular, across the end portions of the primary scanning range of the exposing apparatus 400, the angle of incidence of the beam 408 of laser light relative to the peripheral surface of the photosensitive drum 4 reduces to no more than 70°, making it likely for the portions of the image, which correspond in position to the end portions of the primary scanning range to appear elongaged in the primary scan direction due to the fattening of the latent image dots, which was described above.

Part (a) of FIG. 4 is an enlarged sectional view of the image formation area 407 of the photosensitive drum 4. As the beam 408 of laser light is projected upon the image formation area 407 at an angle of a in the direction indicated by an arrow mark J in the drawing, it transmits through the charge transfer layer 4*d*, and reaches the photosensitive layer 4*c*, in which it forms a latent image by generating electron-positive hole pairs. However, a part of the beam 408 of laser light is reflected by the interface between the charge transfer layer 4*d* and photosensitive layer 4*c*, in the direction indicated by an arrow mark K, is reflected by the interface between the charge transfer layer 4*d* and body of air, in the direction indicated by an arrow mark L in the drawing, and reaches the photosensitive layer 4*c* for the second time. Therefore, the light spot which the beam 408 of laser light forms on the image formation area 407 is greater than the one which is to be formed by the beam 408 of laser light. In other words, the fattening of the latent image dots occurs. By the way, the portion of the image formation area 407, which is actually exposed to the beam 408 of laser light is a combination of the portion of the image formation area 407, which is directly exposed by the beam 408 of laser light, and the portion of the image formation area 407, which is indirectly exposed by the beam 408 of laser light, that is, the portion of the image formation area 407, which was exposed by the portion of the beam 408 of laser light, which was reflected by the aforementioned two interfaces. The amount of the fattening of the latent image dots is inversely proportional to the angle of incidence of the beam 408 of laser light relative to the charge transfer layer 4*d*, and is proportional to the thickness of the charge transfer layer 4*d*. Therefore, the fattening of the latent image dots is more likely to occur when the process cartridge 2 is brand-new than when the cartridge 2 is near the end of its life span. Further, the closer it is to the end portions of the scanning range of the exposing apparatus 400, the more likely it is for the fattening of the latent image dots to occur. The end portions of the scanning range is smaller in the angle of incidence of the beam 408 of laser light relative to the surface layer of the photosensitive drum 4 than the center portion of the scanning range. Further, when the process cartridge 2 is brand-new, the photosensitive drum 4 is greater in film thickness than when the process cartridge 2 is coming to the end of its left span. Moreover, the greater the process cartridge 2 is in yield (total number of prints which process cartridge 2 can yield), the greater the fattening of the latent image is. Further, the greater the photosensitive drum 4 is in film thickness, the greater the fattening of the latent image dots is.

In this embodiment, the light spot which the beam 408 of laser light, which the exposing apparatus 400, emits, forms on the center (which hereafter may be referred to as "central position") of its scanning range, in terms of its primary scan direction, is 80 μm in diameter. The angle α of incidence of the beam 408 of laser light relative to the surface layer of the photosensitive drum 4 at the lengthwise ends (which hereafter may be referred to as "end position") is 58°. By the way, here, the end position means either of the two ends on the scanning range, which are 100 (−100) mm away from the center (0 mm point) of the scanning range. Table 1 shows the relationship among a given point in the scanning range (in terms of primary scan direction), angle of incidence of the beam 408 of laser light relative to the surface layer of the photosensitive drum 4 at the give point, and the film thickness of the photosensitive drum 4.

TABLE 1

| Film | Position | | | | | | | | | | |
|---|---|---|---|---|---|---|---|---|---|---|---|
| | −100 mm | −80 mm | −60 mm | −40 mm | −20 mm | 0 mm | 20 mm | 40 mm | 60 mm | 80 mm | 100 mm |
| | Incident angle | | | | | | | | | | |
| thickness | 58° | 63° | 69° | 76° | 83° | 90° | 83° | 76° | 69° | 63° | 58° |
| 20 μm | 119 μm | 109 μm | 100 μm | 92 μm | 86 μm | 80 μm | 86 μm | 92 μm | 100 μm | 109 μm | 119 μm |
| 15 μm | 113 μm | 104 μm | 97 μm | 90 μm | 84 μm | 80 μm | 84 μm | 90 μm | 97 μm | 104 μm | 113 μm |
| 10 μm | 107 μm | 99 μm | 93 μm | 87 μm | 83 μm | 80 μm | 83 μm | 87 μm | 93 μm | 99 μm | 107 μm |

In a case where the photosensitive drum 4 which is 20 μm, for example, in film thickness is used, the light spot which the beam 408 of laser light forms at the end position becomes 119 μm, because at the end position, the angle α of incidence of the beam 408 of laser light relative to the peripheral surface of the photosensitive drum 4 is smaller than at the central position, and therefore, the light spot which the beam 408 of laser light forms on the image formation area 407 is elongated in the primary scan direction, and also, because the beam 408 of laser light is deflected by the charge transfer layer 4*d*. Part (b) of FIG. 4 is a schematic drawing for showing the shape and size of the light spot formed at the central position (0 mm), and the shape and size of the light sport formed at the end positions (−100 mm, 100 mm), in the case of this comparative (conventional) exposing apparatus 400.

5. Adjustment control 5-1. General concept

As described above, in the case of an exposing apparatus which does not employ a scanning lens which has the f-θ characteristic, the portion of the beam 408 of laser light, which enters the charge transfer layer 4*d*, in the area in which the angle α of incidence of the beam 408 of laser light relative to the charge transfer layer 4*d* is small, is reflected in the charge transfer layer 4*d*, and therefore, the latent image dots are likely to be fatter. This fattening of the latent image dots is proportional to the thickness of the charge transfer layer 4*d*.

In this embodiment, therefore, at least while the beam 408 of laser light is scanning a preset portion of the end portion of the image formation area 407 (scanning range), with reference to the center position, electrical pulses for causing the exposing apparatus 400 to emit the beam 408 of laser light to form each of the latent image dots is reduced in width (which may be referred to as pulse width), according to the film thickness of the photosensitive drum 4. Since the photosensitive drum 4 reduces in film thickness roughly in proportion to the cumulative length of time the photosensitive drum 4 has been rotated, the exposing apparatus 400 is controlled so that the pulse width is less when the process cartridge 2 is brand-new than when the process cartridge 2 is coming to the end of its life span. With this control, it is possible to prevent the beam 408 of laser light from forming fatter light spots when the beam 408 is scanning the preset portion of the end portions of the scanning area, than when it is scanning the central position. Next, this control is described in greater detail.

5-2. Control system

FIG. 5 is a block diagram of the portion of the image forming apparatus 1, which controls the exposing apparatus 400 of the image forming apparatus 1, in pulse width. The laser driving portion 300, with which the exposing apparatus 400 is provided, emits the beam 408 of laser light, in response to the image formation signals outputted from the image formation signal generating portion 100, and the control signals outputted from the control portion 200. The image formation signal generating portion 100 has a signal modulating portion 110. In this embodiment, the signal modulating portion 110 is made up of a pulse width adjusting portion 101 as a pulse width adjusting means, and a pixel inserting portion 102 as a pixel inserting means. These functions of the image formation signal generating portion 100 are realized as the unshown CPU, with which the image formation signal generating portion 100 is provided, controls the signal modulating portion 110, according to the programs stored in the unshown ROM with which the image formation signal generating portion 100 is provided. The image formation signal generating portion 100 receives image data from a host apparatus, such as a host computer, which is connected to the image forming apparatus 1, and generates VDO signals which reflect the image data. While the image formation signal generating portion 100 is generating the VDO signals, it carries out a control sequence for adjusting the pulse width with the use of its pulse width adjusting portion 101 as will be described later. Further, it carries out a control sequence for inserting pixels, with the use of its pixel inserting portion 102 as will be described later.

In this embodiment, the control portion 200 controls the entirety of the image forming apparatus 1. It has: a film thickness information obtaining portion 201 as a film thickness obtaining means; a pulse width determining portion 202 as a pulse width determining means; and a pixel insertion determining portion 203 as a pixel inserting determining means. These functions of the control portion 200 are realized as the control portion 200 follows the programs stored in the unshown ROM with which the control portion 200 is provided. In the ROM with which the control portion 200 is provided, pulse width adjustment information and pixel insertion information, which will be described later, are stored as adjustment information 204 to be used for adjustment control in this embodiment. As will be described later, the control portion 200 calculates the coefficient of adjustment which is necessary for the image formation signal generating portion 100 to generate the VDO signals, according to the film thickness information obtained by the film thickness information obtaining portion 201, and inputs the information regarding the calculated coefficient of adjustment into the image formation signal generating portion 100. During this process, the pulse width determining portion 202 determines the coefficient of frequency increase as the coefficient of adjustment, whereas the pixel insertion determining portion 203 determines the amount, as an adjustment value, by which pixels are to be inserted. Further, each time the photosensitive drum 4 is rotated, the film thickness information obtaining portion 201 counts the length of time the photosensitive drum 4 is rotated, and causes the cartridge memory 3 to cumulatively store the length of the rotation of the photosensitive drum 4. Further, it obtains the current film thickness of the photosensitive drum 4 by reading the current cumulative length of time the photosensitive drum 4 has been rotated, which is in the cartridge memory 3. In this embodiment, the information obtained in advance regarding the relationship between the cumulative length of rotation of the photosensitive drum 4 and the film thickness of the photosensitive drum 4 is stored in the ROM of the control portion 200. Based on this information, the film thickness information obtaining portion 201 obtains the current film thickness of the photosensitive drum 4 from the current cumulative length of rotation of the photosensitive drum 4. However, as described above, the information regarding the film thickness of the photosensitive drum 4 when the photosensitive drum 4 (process cartridge 2) was brand-new has been stored in advance in the cartridge memory 3. Thus, the current film thickness of the photosensitive drum 4 may be obtained based on the amount by which the photosensitive drum 4 has reduced in its film thickness since when it was brand-new, which can be obtained from the cumulative length of time of rotation of the photosensitive drum 4.

As the image formation signal generating portion 100 becomes ready to output the VDO signals for image formation, it sends a print start command to the control portion 200. As the control portion 200 receives this command, it readies the image forming apparatus 1 for a printing operation. Then, as the image forming apparatus 1 becomes ready for a printing operation, the control portion 200 outputs to the image formation signal generating portion 100, the TOP signals, which are secondary scan synchronization signals for informing the control portion 200 of the information regarding the position of the leading edge of a sheet P of transfer medium, and the BD signals which are the primary scan synchronization signals for informing the control portion 200 of the information regarding the position of the left edge of the sheet P. As the image formation signal generating portion 100 receives the two types of synchronization signals described above, it outputs the VDO signals to the laser driving portion 300 of the exposing apparatus 400. The laser driving portion 300 causes the light source 401 to emit light, by supplying the light source 401 with electric current, in response to the VDO signals. In this embodiment, it is the image formation signal generating portion 100 that carries out the process of adjusting the clock (which may be referred to as "image clock") of the VDO signals.

In this embodiment, the means for controlling the exposing apparatus 400 based on the image data is made up of the image formation signal generating portion 100 and control portion 200. By the way, this embodiment is not intended to limit the present invention in scope in terms of the manner in which various functional portions, shown in the block diagram in FIG. 5, are mounted and connected. For example, parts, or entirety, of the functions of the film thickness information obtaining portion 201, pulse width determining portion 202, and pixel insertion determining portion 203 may be performed by the image formation signal generating portion 100.

5-3. Control sequence

Next, referring to the flowchart in FIG. 6, the latent image dot fattening prevention sequence, as the adjustment control, in this embodiment, is described in greater detail. In this embodiment, this adjustment control is executed for each job. Here, a "job" means an operational sequence for forming an image (images) on a single sheet (or two or more sheets) of transfer medium, and outputting the sheet (sheets). This embodiment, however, is not intended to limit the present invention in scope. That is, the adjustment control may be executed each time an image is formed on a single sheet of recording medium, or each time images are formed on two or more sheets of transfer medium, one for one. By the way, "S" in FIG. 6 means "step".

In this embodiment, in the adjustment control, the control portion 200 adjusts the exposing apparatus 400 in the process to be carried out as an exposing process by the exposing apparatus 400, according to the angle of incidence of the beam 408 of laser light or the position in the scanning range, and thickness of the photosensitive drum 4. To describe in greater detail, in the adjustment control, the clock for controlling the timing with which the beam 408 of laser light is to be emitted is changed in frequency, based on the angle of incidence of the beam 408 of laser light relative the surface layer of the photosensitive drum 4, and the film thickness of the photosensitive drum 4. That is, in the adjustment control, pulse width adjustment control sequence, that is, a control sequence for changing the image formation signals for turning on or off the beam 408 of laser light of the exposing apparatus 400, in pulse width, is carried out. Further, in the adjustment control sequence, an image processing sequence and a pixel insertion control sequence are carried out as a control sequence for inserting pixels into the image data, in response to the adjustment of the image clock in frequency.

To begin with, before the starting of a job (image forming operation), the control portion 200 reads the current cumulative length of time of the rotation of the photosensitive drum 4, as film thickness information, stored as film thickness information in the cartridge memory 3, and then, obtains the current film thickness of the photosensitive drum 4, with the use of the film thickness information obtaining portion 201 (S101).

Then, the control portion 200 determines the coefficient of frequency increase, which is the coefficient for adjusting the image clock in frequency, according to the current film thickness of the photosensitive drum 4, based on the pulse width adjustment information set in advance and stored in the ROM of the control portion 200, with the use of the pulse width determining portion 202 (S102). The pulse width adjustment information is set in advance in the form of an adjustment table, which provides information regarding the relationship among a given point (position) in the scanning area, angle of incidence of the beam 408 of laser light relative the surface layer of the photosensitive drum 4, film thickness of the photosensitive drum 4, and coefficient of frequency increase. Table 2 is the adjustment table in this embodiment. In this embodiment, the scanning range was divided into eleven sections, for each of which the frequency increase coefficient for changing the image clock in frequency was set. To describe in greater detail, the scanning range was divided into 11 sections: −110 mm-90 mm (central position: −100 mm), −90 mm--70 mm (central position: −80 mm), −70 mm--50 mm (central position: −60 mm), −50 mm--30 mm (central position: −40 mm), −30 mm--10 mm (central position: −20 mm, 10 mm-30 mm (central position: 20 mm), 30 mm-50 mm (central position: 40 mm), 50 mm-70 mm (central position: 60 mm), 70 mm-90 mm (central position: 80 mm), and 90 mm-110 mm (central position: 100 mm).

Here, if the frequency increase coefficient exceeds 1.00, the image clock increases in frequency. Therefore, laser light emission per pixel reduces in duration. That is, pulse width reduces. In this embodiment, if given two sections of the scanning range are the same in the film thickness of the photosensitive drum 4, the section which is closer to the end of the scanning range is greater in the frequency increase coefficient than the second which is farther from the end of the scanning range. That is, the former is greater in the frequency of the image clock, and smaller in pulse width, than the latter. In other words, assuming that the first section of the scanning range is the same in the film thickness of the photosensitive drum 4 as the second section of the scanning range, the frequency of the image clock of the first section is the first frequency which has the first pulse width. The frequency of the image clock of the section which is closer to the end of the scanning range than the first section is the second frequency which has the second pulse width which is smaller than the first pulse width. Further, in this embodiment, the greater a given point of the scanning range of the peripheral surface of the photosensitive drum 4 is in film thickness, the greater the given point is in frequency increase coefficient. That is, the greater it is in the frequency of the image clock, and smaller in pulse width. In other words, if the film thickness of a given point of the scanning range of the peripheral surface of the photosensitive drum 4 is the first thickness, it is the first frequency which has the first pulse width. If it is the second thickness which is greater than the first thickness, the frequency of its image clock is the second frequency which is greater in pulse width than the second frequency which has the second pulse width which is less than the first pulse width. The frequency increase coefficient for each section of the scanning range is set in advance so that all the sections of the scanning range become roughly the same in the dimension of the light spot in terms of the primary scan direction. The frequency increase coefficient is set for each section of the scanning range to satisfactorily prevent the beam 408 of laser light from forming light spots which are elongated in the primary scan direction.

The information regarding the frequency increase coefficient set for each section of the scanning range is sent to the image formation signal generating portion 100. Then, the control portion 200 carries out the pulse width adjustment control sequence for adjusting, in frequency, the image clock for outputting the VDO signals for forming light spots in each section of the scanning range, based on the frequency increase coefficient determined as described above, with the use of the pulse width adjusting portion 101. The method to be used by the image signal modulating portion 110 of the image formation signal generating portion 100 to change the image clock in frequency is optional. That is, any available method may be used. For example, the image clock can be changed in frequency with the use of a circuit which can convert a clock having a specific frequency, which is generated by an oscillator, into a clock having a desired frequency, with the use of a frequency divider and a multiplier. Therefore, it is possible to make the entirety of the image formation area 407 roughly uniform in the size in which the light spots are formed, regardless of the film thickness of the photosensitive drum 4. That is, it is possible to prevent the beam of laser light emitted from the light source from forming light spots elongated in the primary scan direction.

TABLE 2

| Film thickness | Position: −100 mm | −80 mm | −60 mm | −40 mm | −20 mm | 0 mm | 20 mm | 40 mm | 60 mm | 80 mm | 100 mm |
|---|---|---|---|---|---|---|---|---|---|---|---|
| | Incident angle: 58° | 63° | 69° | 76° | 83° | 90° | 83° | 76° | 69° | 63° | 58° |
| 20 μm | 1.74 | 1.51 | 1.33 | 1.19 | 1.08 | 1.00 | 1.08 | 1.19 | 1.33 | 1.51 | 1.74 |
| 15 μm | 1.57 | 1.38 | 1.25 | 1.14 | 1.07 | 1.00 | 1.07 | 1.14 | 1.25 | 1.38 | 1.57 |
| 10 μm | 1.40 | 1.29 | 1.19 | 1.11 | 1.05 | 1.00 | 1.05 | 1.11 | 1.19 | 1.29 | 1.40 |

Next, the control portion 200 determines the amount by which pixels are to be inserted, according to the frequency increase coefficient set as described above, based on the pixel insertion information set in advance and stored in the ROM of the control portion 200 (S103). By the way, if the image clock is increased in frequency, it sometimes occurs that the scanning area becomes insufficient in the number of image formation signals per section, and therefore, the resultant image appears shrunk in the primary scan direction, toward the point of a sheet P of transfer medium, at which the image begins to be formed. In this embodiment, therefore, in order to prevent the formation of such images that appear shrunk in the primary scan direction, such a step is taken that inserts pixels into the image data for the portion of the image which is to be formed in each section of the image formation area, according to the frequency increase coefficient for each section of the scanning range. FIG. 7 is a schematic drawing which shows an example of image formation process in this embodiment. Part (a) of FIG. 7 presents the original image data, that is, the image data before the original image data was subjected to this image formation process. Part (b) of FIG. 7 represents the image data after they are processed according to the frequency increase coefficient. It shows the image processing for the section (frequency increase coefficient: 1.51) of the scanning range, which includes the position which is 80 mm (or −80 mm) away toward one of the lengthwise ends of the scanning area. In this case, a blank which is equivalent to one pixel was added after the light source 401 was turned on and off to form two pixels. As for the pixel insertion information, the adjustment table has been set in advance as information which shows the relationship among the frequency increase coefficient, and the amount by which pixels are to be inserted into the image data. To describe in greater detail, the amount by which pixels are to be inserted is the number of pixels to be inserted per preset number of pixel of the original image data in terms of the primary scan direction. The information regarding the amount by which the pixels are to be inserted may include the information regarding where pixels are to be inserted.

Here, as the frequency increase coefficient exceeds 1.00, the image clocks increases in frequency, making it necessary to increase the amount by which pixels are to be inserted. In this embodiment, in a case where the photosensitive drum 4 is uniform in film thickness, the closer it is to the end of the scanning area in terms of the primary scan direction, the greater the amount by which pixels are to be inserted. In other words, in a case where the photosensitive drum 4 is uniform in film thickness, the amount (second amount) by which pixels are to be inserted for the second section of the scanning area, which is closer to the end of the scanning area, is greater than the amount (first amount) by which pixels are to be inserted for the first section. Further, in this embodiment, regarding a given section in the scanning range, the greater the section is in the film thickness of the photosensitive drum 4, the greater the amount by which pixels are to be inserted for this section. In other words, regarding a given section in the scanning area, the amount by which pixels are to be inserted for this section in a case where the film thickness of the photosensitive drum 4 which corresponds to this section is equal to the first amount described above. Further, the amount by which pixels are to be inserted for the same section in a case where the film thickness of the photosensitive drum 4 which corresponds to this section is the second thickness which is greater than the first one is the second amount which is greater than the first amount. The amount which is proportional to the frequency increase coefficient, and by which pixels are to be inserted, is set in advance so that it can satisfactorily prevent the formation of images which appear compressed in the primary scan direction. By the way, in the case of a section which is 1.00 in frequency increase coefficient, or the like section, that is, the section which is so small that the formation of the images which appears compressed does not occur, or that even if images which appear compressed are formed, the images are tolerable, it is unnecessary to insert pixels.

The information regarding the amount by which pixels are to be inserted for each section of the scanning area, and which is determined as described above, is sent to the image formation signal generating portion 100. Then, the control sequence for inserting blank pixels into the original image data according to the determined amount described above is carried out. Thus, blank data pixels are added to the image data for the sections which were increased in the frequency of the image clock, to prevent the formation of images which appear compressed in the primary scan direction.

Next, the control portion 200 receives a printing start command, which the image formation signal generating portion 100 is to output as it becomes ready for the outputting of the VDO signals. Then, as the image forming apparatus 1 becomes ready for a printing operation, the control portion 200 outputs the TOP signals and BD signals to the image formation signal generating portion 100 to make the image forming apparatus 1 to start an image forming operation (S104). After the image formation signal generating portion 100 receives the two types of synchronization signals, it outputs the VDO signals to the laser driving portion 300 of the exposing apparatus 400 to start image formation.

Table 3 shows the relationship among the position in the scanning range in terms of the primary scan direction, angle of incidence of the beam 408 of laser light, and thickness of charge transfer layer.

TABLE 3

| Film | Position | | | | | | | | | | |
|---|---|---|---|---|---|---|---|---|---|---|---|
| | −100 mm | −80 mm | −60 mm | −40 mm | −20 mm | 0 mm | 20 mm | 40 mm | 60 mm | 80 mm | 100 mm |
| | Incident angle | | | | | | | | | | |
| thickness | 58° | 63° | 69° | 76° | 83° | 90° | 83° | 76° | 69° | 63° | 58° |
| 20 μm | 79.2 | 79.3 | 79.1 | 79.1 | 79.6 | 80.0 | 79.6 | 79.1 | 79.1 | 79.3 | 79.2 |
| 15 μm | 78.9 | 79.8 | 79.6 | 79.7 | 79.3 | 80.0 | 79.3 | 79.7 | 79.6 | 79.8 | 78.9 |
| 10 μm | 79.7 | 79.3 | 79.1 | 79.2 | 79.1 | 80.0 | 79.1 | 79.2 | 79.1 | 79.3 | 79.7 |

A is evident from Table 3, this embodiment made it possible to make the scanning range roughly uniform in the size of the light spot, regardless of the film thickness of the photosensitive drum 4, and the position in the scanning range. Therefore, it can prevent the image forming apparatus 1 from outputting images which appear compressed in the primary scan direction, or the like unsatisfactory images.

By the way, the relationship shown in Table 2 (adjustment table) is determined by the distance from the polygonal mirror 405 to the image formation area 407 (surface to be scanned), width of the scanning range, film thickness of the photosensitive drum 4, and the like factors. That is, the relationship is not limited to the one shown in Table 2. Further, the frequency increase coefficient may be adjusted in consideration of the index of refraction of the charge transfer layer 4*d*.

Further, the angle of incidence of the beam 408 of laser light relative to the surface layer of the photosensitive drum 4 in the end portions of the scanning range is desired to be no less than 58°, because if the angle of incidence of the beam 408 of laser light is excessively small, the point of the photosensitive layer, onto which the portion of the beam 408 of laser light projected after being deflected by the charge transfer layer 4*d* will be substantially away from the point of the photosensitive layer, upon which the beam 408 of laser light is directly projected. By structuring the exposing apparatus 400 so that the angle of incidence of the beam 408 of laser light will be no less than 58°, it is possible to prevent the problem that the point of the photosensitive layer, upon which a part of the beam 408 of laser light is projected after the part is deflected by the charge transfer layer 4*d* is significantly away from the point of the photosensitive layer, upon which the beam 408 of laser light is directly projected.

Further, in this embodiment, the scanning range was divided into 11 sections, which are varied in steps in the frequency of the image clock. This embodiment, however, is not intended to limit the present invention in scope. That is, the scanning range is made variable in the frequency of the image clock in such away that the frequency continuously changes in terms of the primary scan direction, by the approximate interpolation of the frequency increase coefficients set according to the various film thickness of the photosensitive drum 4.

Moreover, in this embodiment, the range of the film thickness of the photosensitive drum 4 was divided into two or more sections, which are different in the frequency of the image clock. However, this embodiment is not intended to limit the present invention. That is, the control system may be set up so that the image clock is seamlessly changed in frequency according to the film thickness information, by the approximate interpolation of the multiple frequency increase coefficients set according to the film thickness of the photosensitive drum 4.

Further, the end portions of the scanning range are shorter in the length of exposure than the center portion. That is, in a case where a given point of the scanning range is insufficient in the amount of exposure because the point is smaller in the pulse with, the amount of exposure may be changed in accordance with the frequency increase coefficient. Here, the amount of exposure means the amount by which light is shed on a given area per unit area. Thus, all that is necessary is to adjust the beam 408 of laser light in the amount of light, according to the frequency increase coefficient, based on the information regarding the frequency increase coefficient, which is inputted into the laser driving portion 300 from the control portion 200.

As described above, in this embodiment, the image forming apparatus 1 has the photosensitive drum 4 which has: the photosensitive layer 4*c* having the charge generating function, and the charge transfer layer 4*d*, as the surface layer, layered upon the photosensitive layer 4*c*. Further, it has the exposing apparatus 400 which forms a latent image across the scanning range of the peripheral surface of the photosensitive drum 4 in terms of the primary scan direction, by exposing the peripheral surface of the photosensitive drum 4 by scanning the peripheral surface of the photosensitive drum 4 with the beam 408 of laser light in the primary scan direction which is roughly perpendicular to the moving direction of the peripheral surface of the photosensitive drum 4. Moreover, it has: the controlling means which controls the exposing apparatus 400 based on the image data; image formation signal generating portion 100; and control portion 200. Also in this embodiment, the image formation signal generating portion 100 as a controlling means, and the control portion 200, carry out such a control sequence that the pulse width of the image formation signal, which is for turning on or off the beam 408 of laser light of the exposing apparatus 400, based on the image data, become as follows. That is, in a case where the charge transfer layer 4*d*, which is the surface layer, has the first thickness, the pulse width becomes the first one, whereas in a case where the thickness of the charge transfer layer 4*d* is the second thickness, which is greater the first one, the pulse width becomes the second one which is narrower than the first one.

In particular, in this embodiment, during each scan of the scanning range with the beam 408 of laser light in the primary scan direction, the image formation signal generating portion 100 as a controlling means, and control portion 200, controls the exposing apparatus 400 so that the image formation signals are less in pulse width when the second section of the scanning range which is closer to the end of the scanning range than the first section is exposed than when the second section is exposed. In addition, the image formation signal generating portion 100 and control portion 200 carry out the adjustment control sequence, regarding the pulse width at least while the second section is exposed. Also in this embodiment, the image forming apparatus 1 has the film thickness information obtaining portion 201 as a means for obtaining the information regarding the thickness of the charge transfer layer 4*d*, and the image formation signal generating portion 100 and control portion 200, which carry out the adjustment sequence, based on the results obtained by the film thickness information obtaining portion 201. In this embodiment, this obtaining means 201 obtains the information regarding the thickness of the charge transfer layer 4*d*, based on the information having correlation with the amount of usage of the photosensitive drum 4. Further, in this embodiment, the process cartridge 2, as a unit, which includes the photosensitive drum 4, is removably installable in the apparatus main assembly 1*a* of the image forming apparatus 1. It is the process cartridge 2 that is provided with the cartridge memory 3, as a storing means, for storing the information regarding the thickness of the charge transfer layer 4*d*. By the way, in this cartridge memory 3, the information regarding the thickness of the charge transfer layer 4*d* when the photosensitive drum 4 is brand-new may be stored. Here, in this embodiment, the scanning range includes such areas of the peripheral surface of the photosensitive drum 4 that are no more than 70° in the angle of incidence of the beam 408 of laser light relative the surface layer of the photosensitive drum 4, and also, the angle of incidence of the beam 408 of laser light in the scanning range is no less than 58°. Further, in this embodiment, the exposing apparatus 400 is controlled so that the closer it is to the ends of the scanning range from the central point of the scanning range, in terms of the primary scan direction, the smaller the angle of incidence of the beam 408 of laser light relative to the peripheral surface of the photosensitive drum 4.

As described above, in this embodiment, exposing apparatus 400 is controlled so that the pulse for causing the light source 401 to emit the beam 408 of laser light is adjusted in width in accordance with the film thickness of the photosensitive drum 4. Therefore, even in a case where the exposing apparatus 400 does not employ a scanning lens which has the f-θ characteristic, it is possible to prevent the fattening of the latent image dots. Therefore, it is possible to prevent the image forming apparatus 1 from outputting defective images, the defects of which are attributable to the elongated light spots formed by the beam 408 of laser light.

[Embodiment 2]

Next, another embodiment of the present invention is described. The image forming apparatus in this embodiment is the same in basic structure and operation as the one in the first embodiment. Therefore, the elements of the image forming apparatus in this embodiment, which are the same in function or structure as, or correspond in function and structure to, the counterparts of the image forming apparatus in the first embodiment are given the same referential codes as those given to the counterparts, and are not described in detail.

In the first embodiment, adjustment was made by the adjustment of the image clock in frequency, and relevant image processing sequence. In comparison, in this embodiment, adjustment is made only to the image processing sequence.

FIG. 8 is a block diagram of the essential portion of the image forming apparatus 1, which are related to the controlling of the exposing apparatus in this embodiment. In this embodiment, the signal modulating portion 110 of the image formation signal generating portion 100 is provided with a signal compressing portion 103 as a means for compressing image formation signals. This function of compressing image formation signals of the image formation signal generating portion 100 is carried out by an unshown CPU, with which the image formation signal generating portion 100 is provided. That is, in order to compress image formation signals, the CPU controls the signal modulating portion 110 in accordance to the programs stored in the unshown ROM with which the image formation signal generating portion 100 is provided. In this embodiment, the image formation signal generating portion 100 compresses image formation signals with the use of its signal compressing portion 103, when it generates VDO signal which correspond to the received image data. Also in this embodiment, the control portion 200 has: a film thickness information obtaining portion 201, which is similar to the one in the first embodiment; and an image formation signal compressing portion 103 as a means for determining whether or not the signals are to be compressed. These functions of the control portion 200 are carried out by an unshown CPU with which the control portion 200 is provided. That is, the unshown CPU controls the control portion 200 in accordance with the programs stored in the unshown ROM with which the control portion 200 is provided. Further, in the ROM with which the control portion 200 is provided, image formation signal compression information, which will be described later, is stored in advance as adjustment information 204 which is used for the adjustment in this embodiment. In this embodiment, the control portion 200 determines the adjustment coefficient, which is necessary for the image formation signal generating portion 100 to generate the VDO signals, based on the film thickness information obtained by the film thickness information obtaining portion 201. Then, it inputs the information regarding this adjustment coefficient into the image formation signal generating portion 100. During this process, the image formation signal compression determining portion 205 determines the coefficient of image formation signal compression as the adjustment coefficient.

Next, referring to the flowchart in FIG. 9, the process of preventing the formation of fat latent image dots, that is, the adjustment control sequence in this embodiment, is described in greater detail. In this embodiment, this adjustment control sequence is carried out prior to the starting of each job. This embodiment, however, is not intended to limit the present invention in scope. For example, the process may be carried out prior to each time an image is formed on a single sheet of transfer medium, or images are formed on a preset number of sheets of transfer medium. By the way, a letter "S" in FIG. 9 means a step.

As the control portion 200 receives an image formation start command, its obtains the current film thickness of the photosensitive drum 4 by reading the current cumulative length of rotation of the photosensitive drum 4, as the information regarding film thickness, stored in the cartridge memory 3, with the use of the film thickness information obtaining portion 201 (S201).

Next, the control portion 200 determines, with the use of its image formation signal compression determining portion 205, the coefficient of image formation signal compression, which is the coefficient of adjustment, based on the image formation signal compression information set in advance and stored in the ROM of the control portion 200 (S202). As the information for image formation signal compression, an adjustment table is prepared in advance as the information which shows the relationship between the film thickness of the photosensitive drum 4 and coefficient of image formation signal compression, for multiple (11) sections of the scanning range, which are different in the angle of incidence of the beam 408 of laser light relative to the surface layer of the photosensitive drum 4. By the way, the coefficient of image formation signal compression is such compression ratio that indicates the ratio with which the image data are to be compressed in terms of the primary scan direction. In this embodiment, it is information regarding such ratio with which the image data are reduced in pixel count in term of the primary scan direction. However, all that is necessary is that the information is related to the number by which the image data is reduced in pixel count in terms of the primary scan direction. This information regarding the number by which the image data is to be reduced in pixel count in terms of the primary scan direction may contain the information regarding the positions from which pixels are to be removed. Table 4 is the adjustment table in this embodiment. Also in this embodiment, the scanning range is divided into 11 sections, and the coefficient of image formation signal compression is individually set for each section.

Here, if the coefficient of image data compression becomes no more than 1.00, the ratio of reduction of the pixel count becomes higher. That is, the pixel count reduces. In this embodiment, in a case where the photosensitive drum 4 is uniform in film thickness, the closer it is to one of the ends of the scanning range in terms of the primary scan direction, the smaller the coefficient of image data compression is. That is, the higher the pixel count reduction ratio is, and the smaller the pixel count is. In other words, in a case where the photosensitive drum 4 is uniform in film thickness, in terms of the primary scan direction, the value of the pixel count of the image data for the first section of the scanning range is the first one. The value of the pixel count of the second section, which is closer to the end of the scanning range than the first section is the second value which is smaller than the first one. Further, in this embodiment, the greater a given section of the scanning range is in the film thickness of the photosensitive drum 4, the smaller the given section is in the coefficient of image data compression. That is, the higher the given section is in the pixel count reduction ratio, and the smaller it is in the pixel count. In other words, in a case where a given section of the scanning range has the first value in the film thickness of the photosensitive drum 4, the value of the pixel count of the given section is the first one, whereas in a case where the given section of the scanning range has the second value, which is greater than the first value, in the film thickness of the photosensitive drum 4, it has the second value, which is smaller than the first value, in pixel count. The coefficient of compression of image data for each section of the scanning area is set in advance so that each section becomes roughly the same in the size of the light spot. The coefficient of image data compression for each section of the scanning range is set so that it can satisfactorily prevent the formation of images which appear elongated in the primary can direction.

The information regarding the coefficient of image data compression set as described above for each section of the scanning range is sent to the image formation signal generating portion 100. Then, the image data compression control sequence for reducing the original image data in pixel count is carried out by the image data compressing portion 103, in accordance with the coefficient of image data compression set as described above, when the VDO signals for each section of the scanning area are outputted. Thus, the entirety of the image formation area 407 becomes roughly uniform in the size of the light spot. That is, it is possible to satisfactorily prevent the formation of images which appear elongated in the primary scan direction.

TABLE 4

| Film | Position | | | | | | | | | | |
|---|---|---|---|---|---|---|---|---|---|---|---|
| | −100 mm | −80 mm | −60 mm | −40 mm | −20 mm | 0 mm | 20 mm | 40 mm | 60 mm | 80 mm | 100 mm |
| | Incident angle | | | | | | | | | | |
| thickness | 58° | 63° | 69° | 76° | 83° | 90° | 83° | 76° | 69° | 63° | 58° |
| 20 μm | 0.58 | 0.66 | 0.75 | 0.84 | 0.93 | 1.00 | 0.93 | 0.84 | 0.75 | 0.66 | 0.58 |
| 15 μm | 0.64 | 0.73 | 0.80 | 0.88 | 0.94 | 1.00 | 0.94 | 0.88 | 0.80 | 0.73 | 0.64 |
| 10 μm | 0.71 | 0.78 | 0.84 | 0.90 | 0.95 | 1.00 | 0.95 | 0.90 | 0.84 | 0.78 | 0.71 |

FIG. 10 is a schematic drawing which shows an example of processing of image data, in this embodiment. Part (a) of FIG. 10 corresponds to the image data prior to the processing of the data. Part (b) of FIG. 10 corresponds to the image data after processing the data with the use of the coefficient of image data compression. Here, FIG. 10 shows an example of processing of the image data for the section of the scanning range, which includes the point (0.58 in coefficient of image data compression) which is 100 mm (or −100 mm) away from the central position of the scanning range, toward the ends of the scanning range. In this case, in terms of the primary scan direction indicated by an arrow mark R in FIG. 10, the image data was adjusted in the pixel count with the use of a coefficient of image data compression of 0.58. In this case, the pixel count in terms of the primary scan direction indicated by an arrow mark R in the drawing was adjusted with the use of an image compression coefficient of 0.58. Thus, the illuminated portion of pixel in terms of the primary scanning direction was reduced to roughly 60%.

Next, the control portion 200 receives a printing start command, which the image formation signal generating portion 100 is to output as the portion 100 becomes ready to output VDO signals. As soon as the image forming apparatus 1 becomes ready for printing, the control portion 200 outputs TOP signal and BD signal to the image formation signal generating portion 100 to start image formation (S203). After the image formation signal generating portion 100 receives the two types of synchronization signal described above, the image formation signal generating portion 100 outputs VDO signal to the laser driving portion 300 of the exposing apparatus 400, with preset timing, to start image formation.

By the way, in this embodiment, the scanning range was divided into 11 sections, which were varied in step in image data compression ratio. This embodiment, however, is not intended to limit the present invention in scope. That is, the control system may be set up so that the image clock is seamlessly changed in frequency according to the film thickness information, by the approximate interpolation of the multiple frequency increase coefficients set according to the film thickness of the photosensitive drum 4.

Also in this embodiment, the acceptable range for the film thickness for the photosensitive drum 4 was divided into a preset number of sections, which are different in image data compression ratio. This embodiment, however, is not intended to limit the present invention in scope. That is, the control system may set up so that the image data compression ratio is seamlessly changed according to the film thickness information, by the approximate interpolation of the image data compression coefficients set for the multiple film thicknesses of the photosensitive drum 4.

Further, in a case where the end portions of the scanning range of the peripheral surface of the photosensitive drum 4 is insufficiently exposed due to the reduction in pixel count, the amount of exposure may be changed in accordance with the coefficient of image data compression. In such a case, all that is necessary is to adjust a light source in the amount of light, based on the information regarding the image data compression ratio inputted from the control portion 200.

As described above, in this embodiment, the image formation signal generating portion 100 as a controlling means, and the control portion 200, adjust the exposing apparatus 400 in order to adjust the image data so that the data becomes as follows in pixel count, in terms of the primary can direction. That is, assuming here that in a case where the thickness of the charge transfer layer 4*d* has the first value, the pixel count has the first value. The portions 100 and 200 controls the exposing apparatus 400 so that in a case where the thickness of charge transfer layer 4*d* has the second value which is smaller than the first value, the image data is reduced in pixel count from the first value to the second one. In particular, in this embodiment, when the image formation signal generating portion 100 and control portion 200 make the exposing apparatus 400 scan the scanning area in the primary scan direction, they make the second section of the scanning range smaller in the pixel count of the image data in terms of the primary scan direction than the first section. Further, they carry out the adjustment control sequence at least while it is scanning the second section.

As described above, according to this embodiment, the image data is adjusted in pixel count in terms of the primary scan direction in accordance with the film thickness of the photosensitive drum 4. Therefore, this embodiment can prevent an image forming apparatus from suffering from the so-called latent image fattening, even in a case where the image forming apparatus does not employ a scanning lens which has the f-θ characteristic. Therefore, this embodiment can prevent the occurrence of the image defect attributable to the pixel elongation in the primary scan direction. Further, in this embodiment, it is unnecessary to provide the image forming apparatus with a circuit for changing the image clock in frequency. Therefore, the image forming apparatus 1 in this embodiment can provide the same effect as the those described above, while being simpler in structure than the one in the first embodiment.

[Embodiment 3]

Next, another embodiment of the present invention is described. In this embodiment, the present invention was applied to a color image forming apparatus.

1. General structure and operation of image forming apparatus

FIG. 11 is a schematic sectional view of the essential portions of the image forming apparatus 1 in this embodiment. The image forming apparatus 1 in this embodiment is a color laser printer which is capable of forming a full-color image with the use of an electrophotographic image forming method. It is of the so-called intermediary transfer type, and also, of the so-called tandem type. The image forming apparatus 1 has four image forming portions (stations), more specifically, the first, second, third, and fourth image forming portions 11Y, 11M, 11C and 11K which form yellow (Y), magenta (M), cyan (C) and black (K) images, respectively. The elements of the image forming apparatus 1 in this embodiment, which are the same in function or structure to the counterparts in the first embodiment, or correspond in function or structure to the counterparts in the first embodiment, are given the same referential codes as the counterparts, and are not described in detail. By the way, the referential suffixes Y, M, C and K stand for yellow, magenta, cyan, and black colors, respectively. Thus, these suffixes Y, M, C and K may sometimes be intentionally dropped to describe together, the elements which are the same in functions and structure regardless of to which image forming portion they belong.

In this embodiment, each image forming portion 11 has a photosensitive drum 4, a charge roller 5, an exposing apparatus 400, a developing apparatus 6, and a primary transfer roller 8. In the image forming portion 11, a combination of the photosensitive drum 4, and processing means, more specifically, the charge roller 5 and developing apparatus 6, which process the photosensitive drum 4 makes up a process cartridge 2 which is removably installable in the apparatus main assembly 1*a*, as in the first embodiment. Further, each cartridge 2 is provided with a cartridge memory 3 as in the first embodiment.

The image forming apparatus 1 is provided with an intermediary transfer belt 10 as an intermediary transferring member. The intermediary transfer belt 10 is an endless belt, and is positioned so that it faces each of the four photosensitive drums 4. The four process cartridges 11Y, 11M, 11C and 11K are aligned in tandem in the listed order, in the moving direction of the outward surface of the intermediary transfer belt 10, with the process cartridge 11Y positioned most upstream. It is supported and tensioned by multiple rollers. A driving roller, which is one of these rollers by which it is suspended and tensioned, is rotationally driven, the intermediary transfer belt 10 rotates (circularly moves) in the direction indicated by an arrow mark R2 in the drawing. There are disposed four primary transfer rollers 8 as primary transferring members, on the inward side of the loop which the intermediary transfer belt 10 forms. The primary transfer rollers 8 are the primary transferring means, and are positioned so that they oppose corresponding photosensitive drums 4, one for one. Each primary transfer roller 8 is kept pressed toward the corresponding photosensitive drum 4, with the presence of the intermediary transfer belt 10 between itself and the photosensitive drum 4, forming thereby a primary transferring portion N1, in which the photosensitive drum 4 and intermediary transfer belt 10 are in contact with each other. Further, there is disposed a secondary transfer roller 12 as the secondary transferring member on the inward side of the aforementioned belt loop. The secondary transfer roller 12 is the secondary transferring means which is in the form of a roller. It is positioned so that it opposes one of the multiple belt-suspending-and-tensioning rollers, by which the intermediary transfer belt 10 is backed up as the belt 10 is pressed by the secondary transfer roller 12. It is kept pressed toward the belt-backing roller described above, with the presence of the intermediary transfer belt 10 between itself and the secondary transfer roller 12, forming a secondary transferring portion N2, in which the intermediary transfer belt 10 is in contact with the secondary transfer roller 12.

In each image forming portion 11, a yellow, magenta, cyan or black toner image which is in accordance with the information of the image to be formed, is formed on the peripheral surface of the photosensitive drum 4. The yellow, magenta, cyan or black toner image formed on the photosensitive drum 4 is transferred (primary transfer) onto the rotationally moving intermediary transfer belt 10, in the primary transferring portion N1 so that four monochromatic toner images, different in color, are eventually layered on the intermediary transfer belt 10, as in the image forming apparatus 1 in the first embodiment. During the primary transfer process, primary transfer bias, which is opposite in polarity from the normal toner charge is applied to the primary transfer roller 8. The toner image formed on the intermediary transfer belt 10 is transferred (secondary transfer) onto a sheet P of transfer medium, in the secondary transferring portion N2, while the sheet P is conveyed through the secondary transferring nip N2, remaining pinched between the intermediary transfer belt 10 and secondary transfer roller 12. During the secondary transfer process, secondary transfer bias, which is opposite in polarity from the normal toner charge, which the toner has during the developing process, is applied to the secondary transfer roller 12. The sheet P is delivered to the secondary transferring portion N2 from an unshown sheet feeding unit, with such timing that its arrives at the secondary transferring portion N2 at the same time as the toner image on the intermediary transfer belt 10.

After the transfer of the toner image onto the sheet P of transfer medium, the sheet P is subjected to the process of fixing a toner image to the sheet P, by an unshown fixing apparatus, as in the image forming apparatus 1 in the first embodiment. That is, the four monochromatic toner images, different in color, on the sheet P, of which the multicolor image is formed on the sheet P, are subjected to the process of being melted, mixed, and fixed to the sheet P. Then, the sheet P is discharged from the apparatus main assembly 1*a*.

2. Color deviation

Each of the four process cartridges 2 in the image forming apparatus 1 in this embodiment is individually replaceable as necessary. Therefore, it sometimes occurs that the four process cartridges 2 in the image forming apparatus 1 are different in the length of usage, making it possible that the four monochromatic toner images, which are different in the amount of latent image fattening described above, will be formed. Therefore, it sometimes occur that as the four monochromatic toner images are layered, the resultant multicolor images will suffer from defects attributable to color deviation. Moreover, it is possible that even if the four process cartridges 2 in the image forming apparatus 1 are brand-new, they will be different in the film thickness of the photosensitive drum 4. Even in such a case, it is possible to prevent the problem that the image defect attributable to the color deviation similar to the one described above will occur.

The difference in the frequency with which color deviation occurs, between the image forming apparatus in this embodiment and a comparative (conventional) image forming apparatus is described further. In this embodiment, the process cartridges 11Y, 11M, and 11K for yellow, magenta, and black colors, respectively, which were 10 μm in the film thickness of their photosensitive drum 4 are employed. This film thickness of 10 μm is the estimated film thickness of each photosensitive drum 4 at the end of the life span of each process cartridge 11. As for the process cartridge 11C for cyan color, the film thickness of its photosensitive drum 4 was 20 μm. This film thickness of 20 μm is the estimated film thickness of the photosensitive drum 4 in a brand-new process cartridge 11C. Also in this embodiment, the light spot which the beam 408 of laser light forms at the central position in the scanning range is 80 μm in size, and the angle α of incidence of the beam 408 of laser light 408 at the end of the scanning range is 58°, regardless of which of the four process cartridges 11 is concerned with, as in the first embodiment. By the way, here, the end position of the scanning range is represented by the point in the scanning range, which is 100 mm (or −100 mm) away from the center of the scanning range toward the end of the scanning range. Also in this embodiment, the same method as the one used in the first embodiment was used as the method for adjusting the exposing apparatus 400 in the size of the spot which the beam 408 of laser light forms, in order to prevent the image forming apparatus from forming images which appears elongated in the primary scan direction, and which are attributable to the fattening of the latent image dots. As an adjustment table, the aforementioned Table 2 was used. In this embodiment, the light spots were roughly the same in size regardless of the film thickness of the photosensitive drum 4 and the position in the scanning range. That is, this embodiment also can prevent the occurrence of image defects such as the image elongation and color deviation attributable to the fattening of the latent image dots.

On the other hand, in the case of the comparative exposing apparatus 400, the color deviation occurred. By the way, the structure of the comparative image forming apparatus 1 is practically the same as that of the image forming apparatus 1 in this embodiment, except that the comparative image forming apparatus 1 does not carry out the aforementioned adjustment control. FIG. 12 is a schematic drawing for describing the color deviation which the comparative image forming apparatus 1 suffers. Shown in FIG. 12 are the size of the light spot formed at each of the positions in the scanning range, which are −100 mm, 0 mm and 100 mm away from the central position in the primary scan direction, in each of the process cartridges 11Y and 11C, and the images formed on the intermediary transfer belt 10 by the layered yellow and magenta toner images. As for the size of the light spot, the closer it is to one of the ends of the scanning range from the center position (position 0 mm) in the scanning range, the greater the light spot is in size. In the case of the process cartridge C for cyan color, which is relatively greater in the film thickness of the photosensitive drum 4, it is greater in the size of the light spot than the process cartridge Y for yellow color, which is relatively less in the film thickness of the photosensitive drum 4. Thus, when the yellow and cyan toner images are layered upon the intermediary transfer belt 10, the fringe of the yellow toner image suffers from yellow color deviation. These color deviations are likely to occur across the end portions of the scanning range in terms of the primary scan direction.

Therefore, it is likely to be more apparent across the end portions of an image in terms of the primary scan direction, in a case where the image has areas which elongates in the direction parallel to the secondary scan direction.

By the way, the color deviation attributable to the fattening of the latent image dots is likely to be more apparent along the edges of the blank areas of the image. Therefore, the adjustment control may be carried out by selecting the portions to be subjected to the adjustment control, based on the image pattern, such as a portion made up of a single dot, end portions of long lines which are parallel to the primary scan direction. For example, it is possible to design the exposing apparatus 400 so that the adjustment control is carried out only when an image is formed in a preset pattern which is likely to make the color deviation apparent as described above, is formed across the preset portions of the end portion of the scanning range in terms of the primary scan direction. In this case, the image forming apparatus 1 may be designed so that the adjustment control is carried out only in a specific image forming portion 11, such as the image forming portion 11C for cyan color, in the above-described example, which is relatively greater in the film thickness of the photosensitive drum 4, and is likely to cause color deviation. Further, the image forming apparatus 1 may be designed so that the adjustment is made for all the image forming portions.

As described above, in this embodiment, the image forming apparatus 1 has multiple (four) photosensitive drums 4. It can form a color image by forming latent images on the photosensitive drums 4, one for one, forming toner images on the photosensitive drums 4, one for one, by supplying the latent images with developer, and layering the toner images. Further, in this embodiment, the image forming apparatus 1 is designed so that multiple process cartridges 2, as multiple units, each of which contains a photosensitive drum 4, are individually and removably installable in the apparatus main assembly 1*a* of the image forming apparatus 1. Moreover, in this embodiment, each of the multiple process cartridges 2 is provided with the cartridge memory 3 as storing means for storing the information regarding the thickness of the charge transfer layer 4*d* as the surface layer of the photosensitive drum 4 with which the process cartridge 2 is provided. By the way, in this cartridge memory 3, the information regarding the thickness of the charge transfer layer 4*d* of the photosensitive drum 4 when the process cartridge 2 is brand-new may be stored.

As described above, according to this embodiment, it is possible to prevent image elongation by preventing the fattening of latent image dots in each image forming portion 11. Further, it is possible to prevent the occurrence of the image defects attributable to color deviation, even in a case where multiple process cartridges 2 are different in replacement frequency, and/or the multiple process cartridges 2 are different in the film thickness when they are brand-new.

[Others]

In the foregoing, the present invention was described with reference to the concrete embodiments of the present invention. These embodiments, however, are not intended to limit the present invention in scope.

In the embodiments described above, the film thickness information was stored in the cartridge memory 3. However, these embodiments are not intended to limit the present invention in scope in terms of where the film thickness information is stored. For example, the film thickness information may be stored in the storing means with which the main assembly 1*a* of the image forming apparatus 1 is provided. In such a case, the film thickness information may be stored along with the information such as a process cartridge identification code or the like, which makes it possible for the apparatus main assembly 1*a* to identify each process cartridge 2. In such a case, all that is necessary is to design the image forming apparatus 1 so that the adjustment is made based on the film thickness information of the process cartridge 2 identified by the apparatus main assembly 1*a*.

Further, in the embodiments described above, the photosensitive drum 4 was removably installable as a part of the process cartridge 2 in the main assembly 1*a* of the image forming apparatus 1. However, the image forming apparatus 1 may be structured so that the photosensitive drum 4 itself is removably installable in the main assembly 1*a* of the image forming apparatus 1. In such a case, the removably installable photosensitive drum 4 may be provided with the storing means so that the film thickness information can be stored in the storing means. That is, all that is necessary is that the process cartridge 2 which is removably installable in the main assembly 1*a* of the image forming apparatus 1 and contains the photosensitive drum 4 is provided with the storing means in which the information regarding the thickness of the surface layer of the photosensitive drum 4 is storable.

Further, in the embodiments described above, the adjustment control was carried out based on the film thickness information stored in succession in the storing means. These embodiments, however, are not intended to limit the present invention in scope in terms of the information to be used for the adjustment control. For example, in a case where the image forming apparatus 1 is structured so that the film thickness of the photosensitive drum 4 can be directly measured, the adjustment control may be carried out based on the film thickness of the photosensitive drum 4, which was measured in succession. Further, in the embodiments described above, the exposing apparatus 400 had a focal lens which did not have the f-θ characteristic. However, the present invention is also applicable to an image forming apparatus which does not have a focal lens. Such an application also can provide the effects similar to those obtainable by those embodiments of the present invention described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-236492 filed on Dec. 8, 2017, which is hereby incorporated by reference herein in its entirety.

What is claimed is:

1. An image forming apparatus comprising:

a rotatable photosensitive member including a photosensitive layer and a light transmitting surface layer provided outside said photosensitive layer;

an exposing unit configured to expose said surface of said photosensitive member to a laser beam which deflects in a main scan direction substantially perpendicular to a moving direction of said surface of said photosensitive member, so that a latent image is formed on said surface of said photosensitive member in the main scan direction; and a controller configured to control a pulse width of an image signal for switching, on the basis of image data, between projection and non-projection of the laser beam from said exposing unit, wherein the exposure unit exposes the surface of the photosensitive member by scanning the laser beam in the main scanning direction at a non-constant scan rate, and at a non-constant incident angle formed by a rotational axis of the photosensitive member and the laser beam, and wherein said controller controls the pulse width such that the pulse width of an end portion to a central portion of said photosensitive member in the main scan direction is smaller as the laser beam projected to said photosensitive drum is closer to the end portion and is further smaller as the thickness of said surface layer is larger.

2. An image forming apparatus according to claim 1, further comprising an acquiring portion configured to acquire information relating to the thickness of the surface layer, wherein said controller controls the pulse width on the basis of an acquired result of said acquiring portion.

3. An image forming apparatus according to claim 2, wherein said acquiring portion acquires the information relating to the thickness of the surface layer on the basis of information correlated with a use amount of said photosensitive member.

4. An image forming apparatus according to claim 1, wherein a unit including said photosensitive member is detachably mounted in a main assembly of said apparatus, and a storing portion configured to store the information relating to the thickness of the surface layer is provided in said unit including said photosensitive member.

5. An image forming apparatus according to claim 4, wherein said storing portions store the information relating to the thickness of the surface layer of said photosensitive member in an unused condition of said photosensitive member.

6. An image forming apparatus according to claim 1, wherein said apparatus comprises a plurality of such photosensitive members, and an image is formed by superimposing developer images formed by supplying developers to latent images formed on said photosensitive members, respectively.

7. An image forming apparatus according to claim 6, wherein a plurality of units each including said photosensitive member are individually detachably mountable the main assembly of said apparatus, and each of said units including said photosensitive members is provided with said storing portion storing the information relating to the thickness of the surface layer of said photosensitive member in said unit.

8. An image forming apparatus according to claim 7, wherein said storing portions store the information relating to the thickness of the surface layer of said photosensitive member in an unused condition of said photosensitive member.

9. An image forming apparatus according to claim 1, wherein said photosensitive member including a surface area in which the incident angle formed by a rotational axis of the photosensitive member and the laser beam is not more than 70° and not less than 58°.

10. An image forming apparatus according to claim 1, wherein the incident angle formed by a rotational axis of the photosensitive member and the laser beam decreases as is more remote from a central portion of said photosensitive member toward the end portion thereof in the main scan direction.

11. An image forming apparatus according to claim 1, wherein said surface layer is a charge transfer layer.

12. An image forming apparatus according to claim 1, wherein said controller controls the pulse width of the laser beam such that the pulse width to form an electrostatic latent image is smaller as a thickness of the surface layer is larger.

13. An image forming apparatus comprising:

a rotatable photosensitive member including a photosensitive layer and a light transmitting surface layer provided outside said photosensitive layer;

an exposing unit configured to expose said surface of said photosensitive member to a laser beam which deflects in a main scan direction substantially perpendicular to a moving direction of said surface of said photosensitive member, so that a latent image is formed on said surface of said photosensitive member in the main scan direction; and a controller configured to control said exposing unit on the basis of image data, wherein the exposure unit exposes the surface of the photosensitive member by scanning the laser beam in the main scanning direction at a non-constant scan rate, and at a non-constant incident angle formed by a rotational axis of the photosensitive member and the laser beam, and wherein said controller controls said exposing unit such that a number of pixels of the image data of the image to be formed on the surface of said photosensitive member in the main scan direction is smaller as the laser beam projected to said photosensitive drum is closer to the end portion and is further smaller as a thickness of the surface layer is larger.

14. An image forming apparatus according to claim 13, further comprising acquiring means configured to acquire information relating to the thickness of the surface layer, wherein said controller controls the number of pixels of the image on the basis of an acquired result of said acquiring portion.

15. An image forming apparatus according to claim 14, wherein said acquiring portion acquires the information relating to the thickness of the surface layer on the basis of information correlated with a use amount of said photosensitive member.

16. An image forming apparatus comprising:

a rotatable photosensitive member including a photosensitive layer and a light transmitting surface layer provided outside said photosensitive layer;

an exposing unit configured to expose said surface of said photosensitive member to a laser beam which deflects in a main scan direction substantially perpendicular to a moving direction of said surface of said photosensitive member, so that a latent image is formed on said surface of said photosensitive member in the main scan direction; and a controller configured to control a pulse width of an image signal for switching, on the basis of image data, between projection and non-projection of the laser beam from said exposing unit, the pulse width of the image signal being generated on the basis of an image clock, wherein the exposure unit exposes the surface of the photosensitive member by scanning the laser beam in the main scanning direction at a non-constant scan rate, and at a non-constant incident angle formed by a rotational axis of the photosensitive member and the laser beam, and wherein said controller controls the pulse width such that a frequency of the image clock of an end portion to a central portion of said photosensitive member in the main scan direction is greater as the laser beam projected to said photosensitive drum is closer to the end portion and is further greater as the thickness of said surface layer is larger.

17. An image forming apparatus comprising:

a rotatable photosensitive member including a photosensitive layer and a light transmitting surface layer provided outside said photosensitive layer;

an exposing unit configured to expose said surface of said photosensitive member to a laser beam which deflects in a main scan direction substantially perpendicular to a moving direction of said surface of said photosensitive member, so that a latent image is formed on said surface of said photosensitive member in the main scan direction; and a controller configured to control a pulse width of an image signal for switching, on the basis of image data, between projection and non-projection of the laser beam from said exposing unit, wherein the exposure unit exposes the surface of the photosensitive member by scanning the laser beam in the main scanning direction at a non-constant scan rate, and at a non-constant incident angle formed by a rotational axis of the photosensitive member and the laser beam, and wherein said controller controls the pulse width such that the pulse width of an end portion to a central portion of said photosensitive member in the main scan direction is smaller as the laser beam projected to said photosensitive drum is closer to the end portion and is a little smaller as the thickness of said surface layer is smaller.

* * * * *